US012723766B2

(12) United States Patent
Hirawa et al.

(10) Patent No.: US 12,723,766 B2
(45) Date of Patent: Sep. 1, 2026

(54) ELECTRIC COMPONENT UNIT, AND OUTDOOR UNIT OF REFRIGERATION APPARATUS

(71) Applicant: DAIKIN INDUSTRIES, LTD., Osaka (JP)

(72) Inventors: Daiki Hirawa, Osaka (JP); Katsutoshi Sakurai, Osaka (JP); Makoto Takayanagi, Osaka (JP); Taichi Koshiji, Osaka (JP); Hiroaki Matsuda, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 341 days.

(21) Appl. No.: 18/368,300

(22) Filed: Sep. 14, 2023

(65) Prior Publication Data

US 2024/0003555 A1 Jan. 4, 2024

Related U.S. Application Data

(63) Continuation of application No. PCT/JP2022/012173, filed on Mar. 17, 2022.

(30) Foreign Application Priority Data

Mar. 22, 2021 (JP) ..... 2021-047399
Mar. 22, 2021 (JP) ..... 2021-047400

(51) Int. Cl.
*F24F 1/24* (2011.01)

(52) U.S. Cl.
CPC ..... *F24F 1/24* (2013.01)

(58) Field of Classification Search
CPC ..... F24F 1/24; F24F 1/22; F25B 1/00; F25B 49/02
USPC ..... 165/80.4
See application file for complete search history.

(56) References Cited

U.S. PATENT DOCUMENTS

2018/0216836 A1* 8/2018 Hashimoto ..... F24F 1/50
2019/0301753 A1 10/2019 Taniguchi et al.
2020/0158354 A1 5/2020 Kurokawa et al.
2024/0003555 A1* 1/2024 Hirawa ..... F25B 1/00

FOREIGN PATENT DOCUMENTS

CN 1590885 A * 3/2005
CN 100414195 C 8/2008
EP 1862743 A1 12/2007
JP 860076194 A 4/1985

(Continued)

OTHER PUBLICATIONS

International Search Report issued in corresponding International Application No. PCT/JP2022/012173, dated May 10, 2022, with translation (6 pages).

(Continued)

*Primary Examiner* — Steve S Tanenbaum
(74) *Attorney, Agent, or Firm* — Osha Bergman Watanabe & Burton LLP

(57) ABSTRACT

An electric component unit in an outdoor unit of a refrigeration apparatus, includes: a first electric component; a first chamber that houses the first electric component; a second electric component; and a second chamber that houses the second electric component. The first chamber has a higher degree of hermetic sealing than the second chamber.

16 Claims, 10 Drawing Sheets

(56) References Cited

FOREIGN PATENT DOCUMENTS

| | | | |
|---|---|---|---|
| JP | 2010002121 | A | 1/2010 |
| JP | 2010065625 | A | 3/2010 |
| JP | 2010145053 | A | 7/2010 |
| JP | 2011099578 | A | 5/2011 |
| JP | 2012167862 | A | 9/2012 |
| JP | 2016205676 | A | 12/2016 |
| JP | 2019148362 | A | 9/2019 |
| WO | 2017022001 | A1 | 2/2017 |
| WO | 2018016064 | A1 | 1/2018 |

OTHER PUBLICATIONS

Extended European Search Report issued in European Application No. 22775378.7, dated Aug. 1, 2024 (10 pages).
International Preliminary Report on Patentability issued in corresponding International Application No. PCT/JP2022/012173, dated Sep. 12, 2023, (7 pages).

* cited by examiner

ELECTRIC COMPONENT UNIT, AND OUTDOOR UNIT OF REFRIGERATION APPARATUS

CROSS-REFERENCE TO RELATED APPLICATIONS

This is a continuation application of International Patent Application No. PCT/JP2022/012173, filed Mar. 17, 2022, and claims priority to Japanese Patent Application No. 2021-047399, filed Mar. 22, 2021 and to Japanese Patent Application No. 2021-047400, filed Mar. 22, 2021. The contents of these priority applications are incorporated by reference.

TECHNICAL FIELD

The present disclosure relates to an electric component unit, and an outdoor unit of a refrigeration apparatus.

BACKGROUND

Conventionally, outdoor units for refrigeration apparatuses such as air conditioners have been used, including components such as a compressor and heat exchanger that constitute a refrigerant circuit, and an electric component unit for controlling the various components.

For example, in a refrigeration apparatus disclosed in Patent Literature 1 (JP 2010-2121 A), a part of a refrigerant pipe in a refrigerant circuit is disposed on one side of the casing of an electric component unit in order to cool heat-generating components included in the electric component unit. Furthermore, the interior of the casing of the electric component unit is filled with insulating liquid having excellent thermal conductivity. As a result, in the refrigeration apparatus according to Patent Literature 1, it is not necessary to provide in the casing a large opening that allows passage of airflow for cooling the heat-generating components, so that the intrusion of dust can be prevented and the heat-generating components can be cooled.

SUMMARY

An electric component unit according to one or more embodiments is provided in an outdoor unit of a refrigeration apparatus, and includes a first electric component, a first chamber that houses the first electric component, a second electric component, and a second chamber that houses the second electric component. The first chamber has a higher degree of hermetic sealing than the second chamber.

DETAILED DESCRIPTION

(1) Configuration of Refrigeration Apparatus

Figure 1:
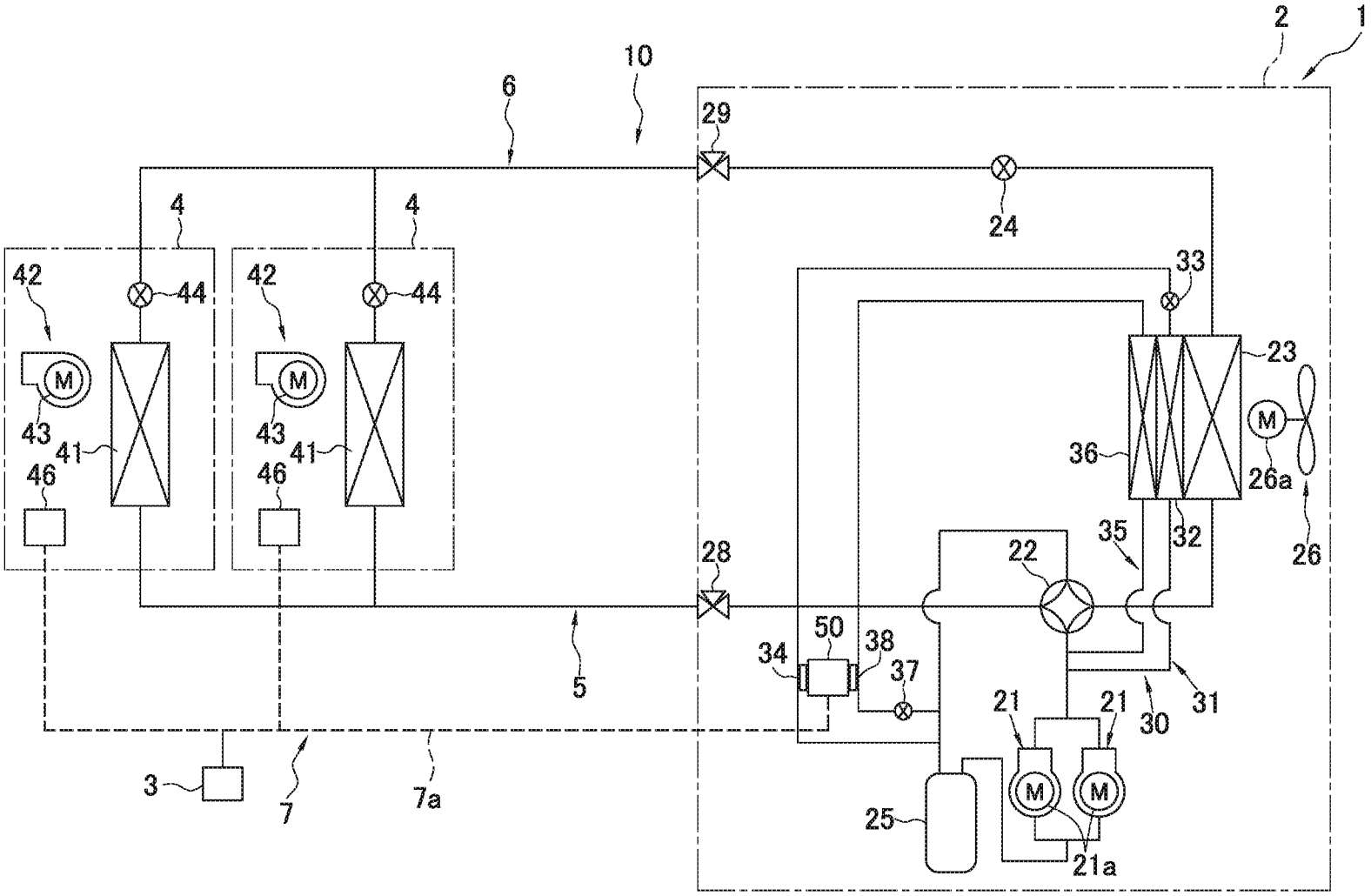
FIG. 1 is an overall configuration diagram of a refrigeration apparatus according to one or more embodiments.

FIG. 1 is a schematic configuration diagram of a refrigeration apparatus 1.

The refrigeration apparatus 1 is used for cooling and heating a room in a building or the like by vapor compression refrigeration cycle operation. The refrigeration apparatus 1 mainly includes an outdoor unit 2, an indoor unit 4, and a liquid-side refrigerant communication pipe 6 and a gas-side refrigerant communication pipe 5 that allow communication between the outdoor unit 2 and the indoor unit 4. A refrigerant circuit 10 of the refrigeration apparatus 1 is configured by connecting the outdoor unit 2, the indoor unit 4, the liquid-side refrigerant communication pipe 6, and the gas-side refrigerant communication pipe 5.

Note that the refrigerant circuit 10 according to one or more embodiments is filled with an optional refrigerant such as R410A or R32.

(1-1) Indoor Unit

The indoor unit 4 is installed by being embedded in or suspended from the ceiling of a room in a building or the like, or by being hung on the wall surface of the room. The indoor unit 4 is connected to the outdoor unit 2 through the liquid-side refrigerant communication pipe 6 and the gas-side refrigerant communication pipe 5, and constitutes part of the refrigerant circuit 10.

Note that in the refrigeration apparatus 1 according to one or more embodiments, there are a plurality of the indoor units 4 connected in parallel to each other in the refrigerant circuit Since the indoor units 4 have the same configuration, one of the indoor units 4 will be described below.

The indoor unit 4 mainly has an indoor expansion valve 44, an indoor heat exchanger 41, an indoor fan 42, and an indoor control unit 46.

The indoor heat exchanger 41 is, for example, a cross-fin type fin-and-tube heat exchanger configured from a heat transfer tube and a large number of fins. The indoor heat exchanger 41 functions as an evaporator for the refrigerant and cools indoor air during cooling operation, and functions as a radiator or condenser for the refrigerant and heats indoor air during heating operation. The gas-side refrigerant communication pipe 5 is connected to the gas side of the indoor heat exchanger 41.

The indoor expansion valve 44 is an electronic expansion valve, the valve opening degree of which is adjustable. The indoor expansion valve 44 is provided in the refrigerant flow path between the indoor heat exchanger 41 and the liquid-side refrigerant communication pipe 6.

The indoor unit 4 has the indoor fan 42 that sucks indoor air into the unit and after causing the indoor heat exchanger 41 to exchange heat between the sucked indoor air and the refrigerant, supplies the heat-exchanged air as supply air into the room. The indoor fan 42 is a centrifugal fan, a multiblade fan, or the like. The indoor fan 42 has an indoor fan motor 43.

The indoor control unit 46 controls the operation of the components that constitute the indoor unit 4. The indoor control unit 46 has a microcomputer, a memory, and the like provided to control the indoor unit 4. The indoor control unit 46 can exchange control signals and the like with an outdoor control unit 50 of the outdoor unit 2 or a remote controller 3 through a transmission line 7*a*.

(1-2) Outdoor Unit

The outdoor unit 2 is installed outside a building or the like, and is connected to the indoor units 4 through the liquid-side refrigerant communication pipe 6 and the gas-side refrigerant communication pipe 5.

Figure 2:
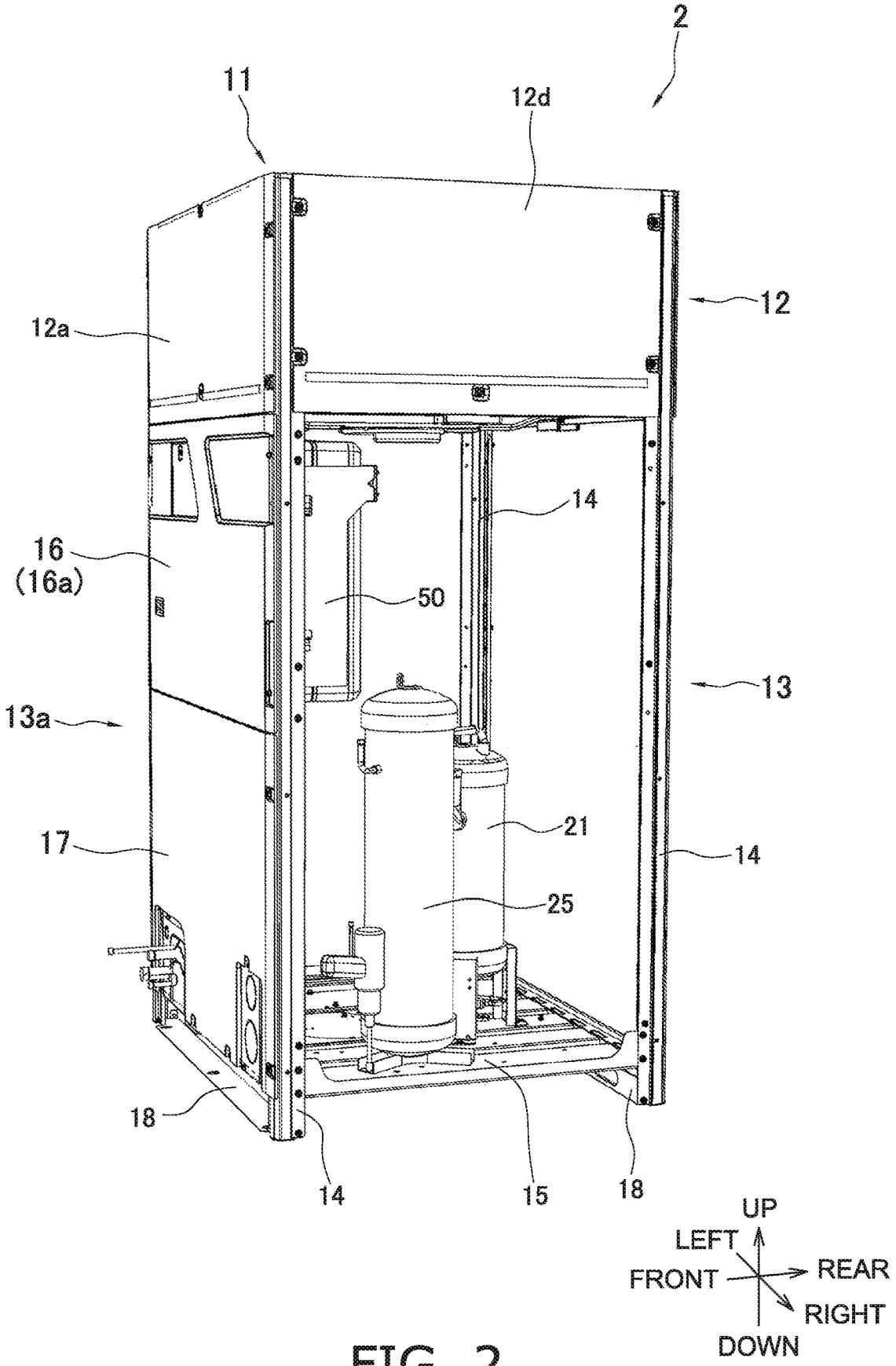
FIG. 2 is an external perspective view of an outdoor unit.
Figure 3:
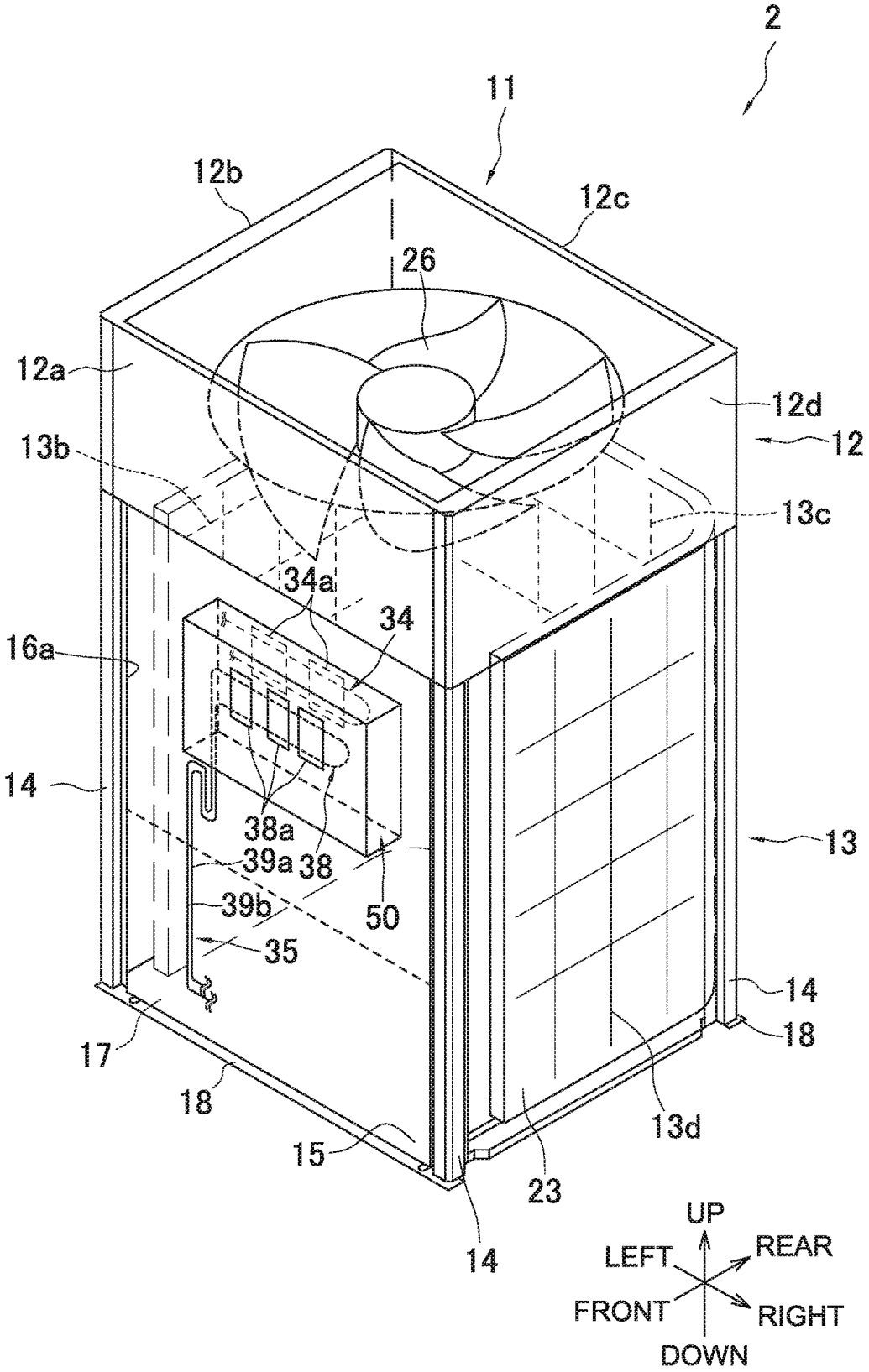
FIG. 3 is a schematic external perspective view illustrating the arrangement and the like of an outdoor control unit in the outdoor unit.

FIG. 2 is an external perspective view of the outdoor unit 2. In FIG. 2, part of the internal configuration of the outdoor unit 2 is omitted. Note that in the following description, unless otherwise specified, "upper", "lower", "left", "right", "front", and "rear" refer to the directions when the outdoor unit 2 illustrated in FIG. 2 is viewed from the front (left oblique front side in the drawing). Here, in one or more embodiments, the direction in which the surface without the outdoor heat exchanger 23 or the surface with the smallest portion where the outdoor heat exchanger 23 is present is located is referred to as "front" as viewed from the center of the outdoor unit 2 in plan view. Note that in FIG. 2, main equipment and the outdoor control unit 50 inside the outdoor unit 2 are mainly illustrated, and the outdoor heat exchanger 23, other pipes, and the like are omitted. In addition, FIG. 3 is a schematic external perspective view illustrating the arrangement and the like of the outdoor control unit 50 in the outdoor unit 2. In FIG. 3, the outdoor control unit 50, a first cooling portion 34 and second cooling portion 38 in the periphery thereof, the outdoor heat exchanger 23, an outdoor fan 26, and the like are mainly illustrated, and other equipment, pipes, and the like are omitted.

The outdoor unit 2 mainly has an outdoor unit casing 11, a compressor 21, a four-way switching valve 22, the outdoor heat exchanger 23, an outdoor expansion valve 24, an accumulator 25, a liquid-side shutoff valve 29, a gas-side shutoff valve 28, a cooling circuit 30, the outdoor fan 26, the outdoor control unit 50, and the like.

In one or more embodiments, the outdoor unit 2 is a top-blowing heat exchange unit that sucks air from the left and right side surfaces and the back surface of the outdoor unit casing 11 and blows the air upward from the upper end surface of the outdoor unit casing 11.

The outdoor unit casing 11 mainly has a main portion 13 and a fan module 12 provided on top of the main portion 13.

The main portion 13 has a pair of installation legs 18, a bottom frame 15, four supports 14, a front panel 13*a*, and mesh portions 13*b*, 13*c*, and 13*d*. The installation legs 18 are provided, one on the front side and one on the rear side, and extend in the left-right direction. The bottom frame 15 is bridged over the installation legs 18. The supports 14 extend vertically from the corners of the bottom frame 15. The front panel 13*a* extends between the two supports 14 on the front side. The mesh portion 13*b* is provided so as to extend forward and backward between the supports 14 on the left side. The mesh portion 13*c* is provided so as to extend to the left and right between the supports 14 on the rear side. The mesh portion 13*d* is provided so as to extend forward and backward between the supports 14 on the right side.

The bottom frame 15 forms the bottom of the outdoor unit casing 11, and the outdoor heat exchanger 23 is provided on the bottom frame 15. Here, the outdoor heat exchanger 23 has a substantially U-shape in plan view facing the back surface and both left and right side surfaces of the outdoor unit casing 11.

Note that each of the mesh portions 13*b*, 13*c*, and 13*d* is provided so as to extend along the outer surface of the outdoor heat exchanger 23. These mesh portions 13*b*, 13*c*, and 13*d* substantially form three suction ports on the right side, left side, and back side in the outdoor unit casing 11.

The front panel 13*a* has an upper front panel 16 constituting the upper portion of the front surface of the outdoor unit casing 11 and a lower front panel 17 constituting the lower portion of the front surface of the outdoor unit casing 11.

The fan module 12 is attached to the upper ends of the supports 14. The fan module 12 is a substantially rectangular parallelepiped box having a front side plate 12*a*, a left side plate 12*b*, a back side plate 12*c*, and a right side plate 12*d*, and penetrates in the vertical direction. The fan module 12 houses the outdoor fan 26 therein to form a flow path for an upward air flow.

The compressor 21 is, for example, a positive-displacement compressor driven by a compressor motor 21*a*. In one or more embodiments, the two compressors 21 are connected in parallel to each other. The compressor motor 21*a* is driven by being supplied with power through an inverter device. The operating capacity of the compressor 21 is variable by changing the drive frequency of the compressor motor 21*a* and varying the number of rotation. The discharge side of the compressor 21 is connected to one of a plurality of connection ports of the four-way switching valve 22. In one or more embodiments, the compressor 21 is placed on the bottom frame 15.

The accumulator 25 is a refrigerant reservoir provided between the suction side of the compressor 21 and one of the plurality of connection ports of the four-way switching valve 22. In one or more embodiments, the accumulator 25 is placed on the bottom frame 15.

The outdoor heat exchanger 23 is, for example, a cross-fin type fin-and-tube heat exchanger configured from a heat transfer tube and a large number of fins. The outdoor heat exchanger 23 functions as a radiator or condenser for the refrigerant during the cooling operation, and functions as an evaporator for the refrigerant during the heating operation. One of the plurality of connection ports of the four-way switching valve 22 is connected to the gas side of the outdoor heat exchanger 23 through a refrigerant pipe. The outdoor expansion valve 24 is connected to the liquid side of the outdoor heat exchanger 23 through the refrigerant pipe.

The outdoor fan 26 is housed in the fan module 12. The outdoor fan 26 sucks outdoor air from the lower periphery of the outdoor unit casing 11 into the interior, thereby forming an air flow that, after causing the outdoor heat exchanger 23 to exchange heat between the sucked outdoor air and the refrigerant, discharges the heat-exchanged air upward through a blow-out port that is provided on the upper end surface of the fan module 12. The outdoor fan 26 is a propeller fan or the like driven by an outdoor fan motor 26*a*, which is a DC fan motor, and has a variable air volume. In one or more embodiments, the outdoor fan motor 26*a* is driven by being supplied with power through an inverter device.

The outdoor expansion valve 24 is an electric expansion valve, the valve opening degree of which is adjustable in order to adjust the flow rate of the refrigerant flowing in the refrigerant circuit 10. The outdoor expansion valve 24 is provided between the liquid-side outlet of the outdoor heat exchanger 23 and the liquid-side shutoff valve 29.

The four-way switching valve 22 has the plurality of connection ports. The four-way switching valve 22 switches the refrigerant circuit 10 between the cooling operation connection state and the heating operation connection state by switching the connection state of the plurality of connection ports. In the cooling operation connection state, the discharge side of the compressor 21 and the outdoor heat exchanger 23 are connected, and the suction side of the compressor 21 and the gas-side shutoff valve 28 are connected. In the heating operation connection state, the discharge side of the compressor 21 and the gas-side shutoff valve 28 are connected, and the suction side of the compressor 21 and the outdoor heat exchanger 23 are connected.

The liquid-side shutoff valve 29 is provided at a connecting port with the liquid-side refrigerant communication pipe 6. The liquid-side shutoff valve 29 is connected to the opposite side of the outdoor expansion valve 24 to the outdoor heat exchanger 23 side through the refrigerant pipe. The gas-side shutoff valve 28 is provided at a connecting port with the gas-side refrigerant communication pipe 5. The gas-side shutoff valve 28 is connected to one of the plurality of connection ports of the four-way switching valve 22 through the refrigerant pipe.

The cooling circuit 30 is used to cool the electric components such as heat-generating components, to be described later, of the outdoor control unit 50, and has a first cooling circuit 31 and a second cooling circuit 35.

The first cooling circuit 31 branches from between the discharge side of the compressor 21 and one of the plurality of connection ports of the four-way switching valve 22, and causes the refrigerant to flow so as to merge between one of the plurality of connection ports of the four-way switching valve 22 and the accumulator 25. The first cooling circuit 31 has a first heat exchanger 32, a first expansion valve 33, and the first cooling portion 34. The first heat exchanger 32, the first expansion valve 33, and the first cooling portion 34 are provided such that the refrigerant flows in this order in the first cooling circuit 31. Note that in one or more embodiments, the first heat exchanger 32 is integrated with the outdoor heat exchanger 23 and a second heat exchanger 36 to be described later by sharing the heat transfer fins. The first expansion valve 33 is an electric expansion valve, the valve opening degree of which is adjustable in order to adjust the flow rate of the refrigerant flowing in the first cooling circuit 31. The first cooling portion 34 is provided so as to cool the space in which the electric components such as heat-generating components of the outdoor control unit 50 are housed, from the back side of the outdoor control unit 50 via first heat transfer members 34*a* to be described later.

The second cooling circuit 35 branches from between the discharge side of the compressor 21 and one of the plurality of connection ports of the four-way switching valve 22, and causes the refrigerant to flow so as to merge between one of the plurality of connection ports of the four-way switching valve 22 and the accumulator 25. The second cooling circuit has the second heat exchanger 36, the second cooling portion 38, and a second expansion valve 37. The second heat exchanger 36, the second cooling portion 38, and the second expansion valve 37 are provided so that the refrigerant flows in this order in the second cooling circuit 35. Note that in one or more embodiments, the second heat exchanger 36 is integrated with the outdoor heat exchanger 23 and the first heat exchanger 32 by sharing the heat transfer fins. The second expansion valve 37 is an electric expansion valve, the valve opening degree of which is adjustable in order to adjust the flow rate of the refrigerant flowing in the second cooling circuit 35. The second cooling portion 38 is provided so as to be in thermal contact with and cool the electric components such as heat-generating components of the outdoor control unit 50 from the front side via second heat transfer members 38*a* to be described later.

Figure 4:
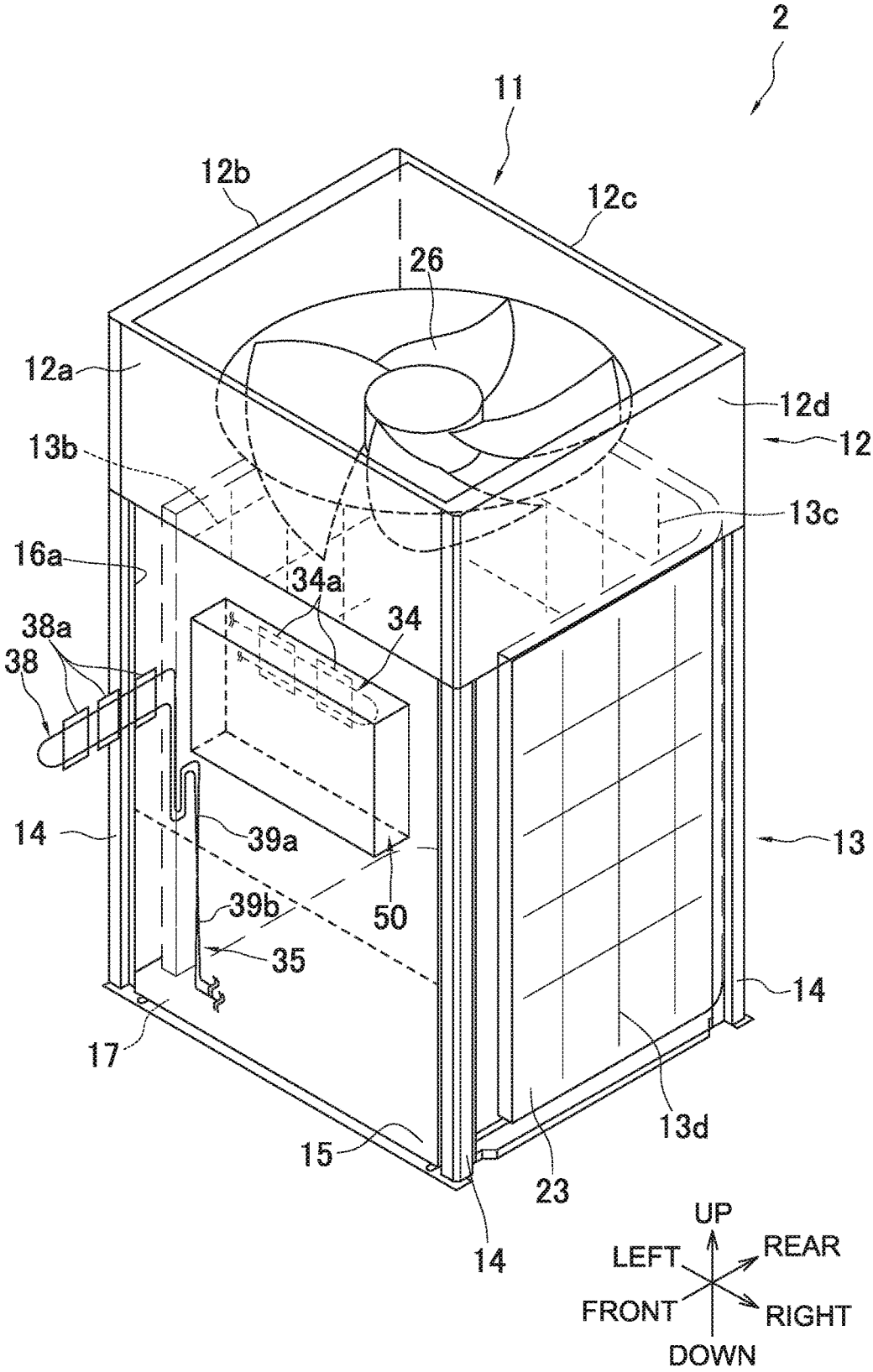
FIG. 4 is a schematic external perspective view illustrating a state where a second cooling portion is moved.

Note that although details will be described later, when constructing the outdoor unit 2 or performing maintenance of the outdoor control unit 50 and the like of the outdoor unit 2, the second cooling portion 38 in the second cooling circuit 35 is moved toward the front as illustrated in FIG. 4. Specifically, by rotating, in a twisting manner, a first connection pipe 39*a* and a second connection pipe 39*b* that extend from both ends of the second cooling portion 38, the second cooling portion 38 is turned out forward, and the construction and maintenance of the outdoor control unit 50 and the like are performed.

In addition, the outdoor unit 2 is provided with various sensors (not illustrated).

The outdoor control unit 50 is provided below the fan module 12, close to the front side, and facing the back side of the upper front panel 16, in the outdoor unit casing 11. More specifically, the outdoor control unit 50 is located forward of the compressor 21 and the accumulator 25. The outdoor control unit 50 can be accessed by a local worker through an opening 16*a* that is exposed when the upper front panel 16 of the outdoor unit casing 11 is removed. Note that the opening 16*a* is bordered by the support 14 located at the left front, the support 14 located at the right front, the lower edge of the front side plate 12*a* of the fan module 12, and the upper edge of the lower front panel 17, and is open in the front-rear direction. The outdoor control unit 50 controls the operation of the components that constitute the outdoor unit 2. The outdoor control unit 50 has a microcomputer and a memory provided to control the outdoor unit 2, and controls the states of the compressor motor 21*a*, the outdoor fan motor 26*a*, the outdoor expansion valve 24, the four-way switching valve 22, the first expansion valve 33, the second expansion valve 37, and the like. The outdoor control unit 50 can exchange control signals and the like with the indoor control units 46 of the indoor units 4 and the remote controller 3 through the transmission line 7*a*. The above-described indoor control units 46, outdoor control unit 50, and remote controller 3 are connected to each other by the transmission line 7*a* to constitute a control unit 7 that controls the operation of the entire refrigeration apparatus 1.

The control unit 7 is connected so as to be able to receive detection signals from various sensors (not illustrated), and also controls various equipment on the basis of these detection signals or the like. Note that the control unit 7 has a CPU that executes the above-described various controls, a memory that stores information used for executing the various controls, and the like.

(1-3) Refrigerant Communication Pipe

The liquid-side refrigerant communication pipe 6 and the gas-side refrigerant communication pipe 5 are refrigerant pipes that are constructed on site when installing the refrigeration apparatus 1 in an installation place such as a building.

Note that, in the refrigeration apparatus 1 according to one or more embodiments having the plurality of indoor units 4, the liquid-side refrigerant communication pipe 6 has a branch portion corresponding to each of the indoor units, and the gas-side refrigerant communication pipe 5 has a branch portion corresponding to each of the indoor units.

(2) Refrigeration Cycle in Refrigerant Circuit

The refrigerant circuit 10 of the refrigeration apparatus 1 mainly performs cooling operation and heating operation by switching the connection state of the four-way switching valve 22. Here, the operation of the portion of the refrigerant circuit 10 other than the cooling circuit 30 will be described.

(2-1) Cooling Operation

The cooling operation is performed in a state where the connection state of the four-way switching valve 22 is switched such that the discharge side of the compressor 21 is on the outdoor heat exchanger 23 side and the suction side of the compressor 21 is on the indoor heat exchanger 41 side.

The compressor 21 is frequency controlled, for example, to process the cooling load in each of the indoor units 4. As a result, the low-pressure refrigerant sucked into the compressor 21 is discharged from the compressor 21 to become a high-pressure refrigerant, which flows through the four-way switching valve 22 into the outdoor heat exchanger 23.

The refrigerant flowing into the outdoor heat exchanger 23 radiates heat and condenses. The refrigerant flowing out of the outdoor heat exchanger 23 passes through the outdoor expansion valve 24, which is controlled to be fully open by the control unit 7 during the cooling operation.

The refrigerant that has passed through the outdoor expansion valve 24 passes through the liquid-side shutoff valve 29 and is sent to the liquid-side refrigerant communication pipe 6.

The refrigerant flowing through the liquid-side refrigerant communication pipe 6 is branched and then sent to each of the indoor units 4.

The refrigerant flowing into each of the indoor units 4 is decompressed to the low pressure of the refrigeration cycle at the indoor expansion valve 44. Note that the control unit 7 controls the valve opening degree of the indoor expansion valve 44 such that, for example, the degree of superheating of the refrigerant on the outlet side of the indoor heat exchanger 41 becomes a predetermined target degree of superheating.

The refrigerant decompressed by the indoor expansion valve 44 of each of the indoor units 4 evaporates in the indoor heat exchanger 41. The respective refrigerants evaporated in the indoor heat exchangers 41 merge, and flow through the gas-side refrigerant communication pipe 5.

The refrigerant flowing through the gas-side refrigerant communication pipe 5 is sucked again into the compressor 21 through the gas-side shutoff valve 28, four-way switching valve 22, and accumulator 25 of the outdoor unit 2.

(2-2) Heating Operation

The heating operation is performed in a state where the connection state of the four-way switching valve 22 is switched such that the discharge side of the compressor 21 is on the indoor heat exchanger 41 side and the suction side of the compressor 21 is on the outdoor heat exchanger 23 side.

The compressor 21 is frequency controlled, for example, to process the heating load in each of the indoor units. As a result, the high-pressure refrigerant discharged from the compressor 21 flows toward the indoor units 4 via the four-way switching valve 22 and the gas-side refrigerant communication pipe 5.

Here, the refrigerant that has passed through the gas-side refrigerant communication pipe 5 branches off and flows into each of the indoor units 4.

The refrigerant flowing into each of the indoor units 4 radiates heat and condenses in the indoor heat exchanger 41. Note that during the heating operation, the valve opening degree of each of the indoor expansion valves 44 is controlled such that the degree of subcooling of the refrigerant flowing through the outlet of the indoor heat exchanger 41 becomes a predetermined value, for example.

In this way, the respective refrigerants condensed in the indoor heat exchangers 41 and passing through the indoor expansion valves 44 merge, and flow through the liquid-side refrigerant communication pipe 6.

The refrigerant flowing through the liquid-side refrigerant communication pipe 6 is supplied to the outdoor unit 2 through the liquid-side shutoff valve 29. The refrigerant that has passed through the liquid-side shutoff valve 29 is decompressed to the low pressure of the refrigeration cycle at the outdoor expansion valve 24. Specifically, for example, the valve opening degree of the outdoor expansion valve 24 is controlled such that the degree of superheating of the refrigerant flowing through the suction side of the compressor 21 becomes a target degree of superheating.

The refrigerant sent to the outdoor heat exchanger 23 evaporates and is sucked again into the compressor 21 via the four-way switching valve 22 and the accumulator 25.

(3) Refrigerant Flow in Cooling Circuit

Here, the operation of the cooling circuit 30 in the refrigerant circuit 10 will be described.

The refrigerant can flow through the first cooling circuit 31 and the second cooling circuit 35 of the cooling circuit 30 during both the cooling operation and the heating operation. During both the cooling operation and the heating operation, more specifically, the outdoor control unit 50 may control the valve opening degrees of the first expansion valve 33 and the second expansion valve 37 so that the refrigerant flows to the first cooling circuit 31 and the second cooling circuit 35 at all times when the compressor 21 is driven.

Here, the refrigerant discharged from the compressor 21 and decompressed by first expansion valve 33 after radiating heat in the first heat exchanger 32 is guided to the first cooling portion 34 of the first cooling circuit 31. At least some of the refrigerant flowing through the first cooling portion 34 is evaporated by receiving the heat from the heat-generating components of the outdoor control unit 50, and flows toward the accumulator 25.

In addition, the refrigerant discharged from the compressor 21 and after radiating heat in second heat exchanger 36 is guided to the second cooling portion 38 of the second cooling circuit 35. At least some of the refrigerant flowing through the second cooling portion 38 evaporates by receiving the heat from the heat-generating components of the outdoor control unit 50, is decompressed when passing through the second expansion valve 37, and flows toward the accumulator 25.

Therefore, the temperature of the refrigerant flowing through the first cooling portion 34 is different from the temperature of the refrigerant flowing through the second cooling portion 38, and the temperature of the refrigerant flowing through the first cooling portion 34 is lower.

Note that in one or more embodiments, the pipe portions that constitute the first cooling circuit 31 and the second cooling circuit 35 are copper pipes. The pipe portions that constitute the first cooling circuit 31 and the second cooling circuit 35 have uniform material and pipe diameter in one or more embodiments. The pipe diameter of the pipe portions that constitute the first cooling circuit 31 and the second cooling circuit 35 is smaller than the pipe diameter of the main pipe portion in the refrigerant circuit 10, for example, the nominal pipe diameter may be ½ inch or less (outer diameter of 12.7 mm or less), ⅜ inch or less (outer diameter of 9.52 mm or less), or ¼ inch or less (outer diameter of 6.35 mm or less). Here, the main pipe portion of the refrigerant circuit 10 can be, for example, a pipe connected to the outdoor heat exchanger 23.

(4) Detailed Configuration of Outdoor Control Unit

Figure 5:
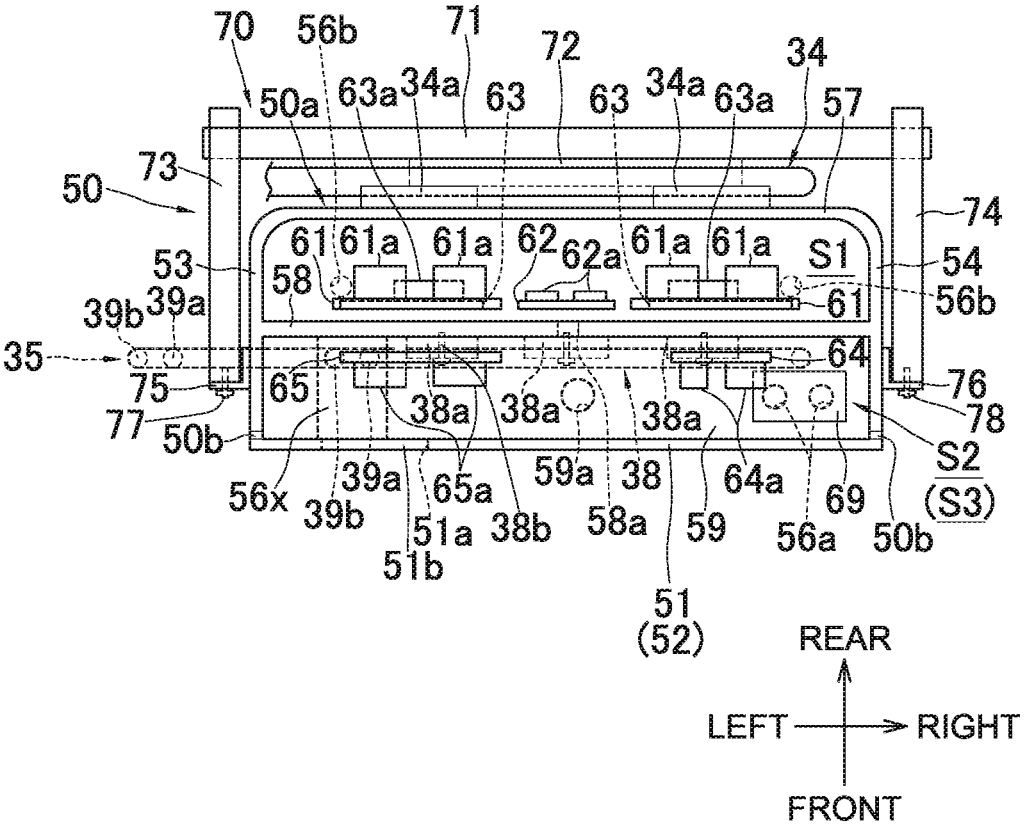
FIG. 5 is a schematic configuration diagram of the interior of the outdoor control unit in plan view.
Figure 6:
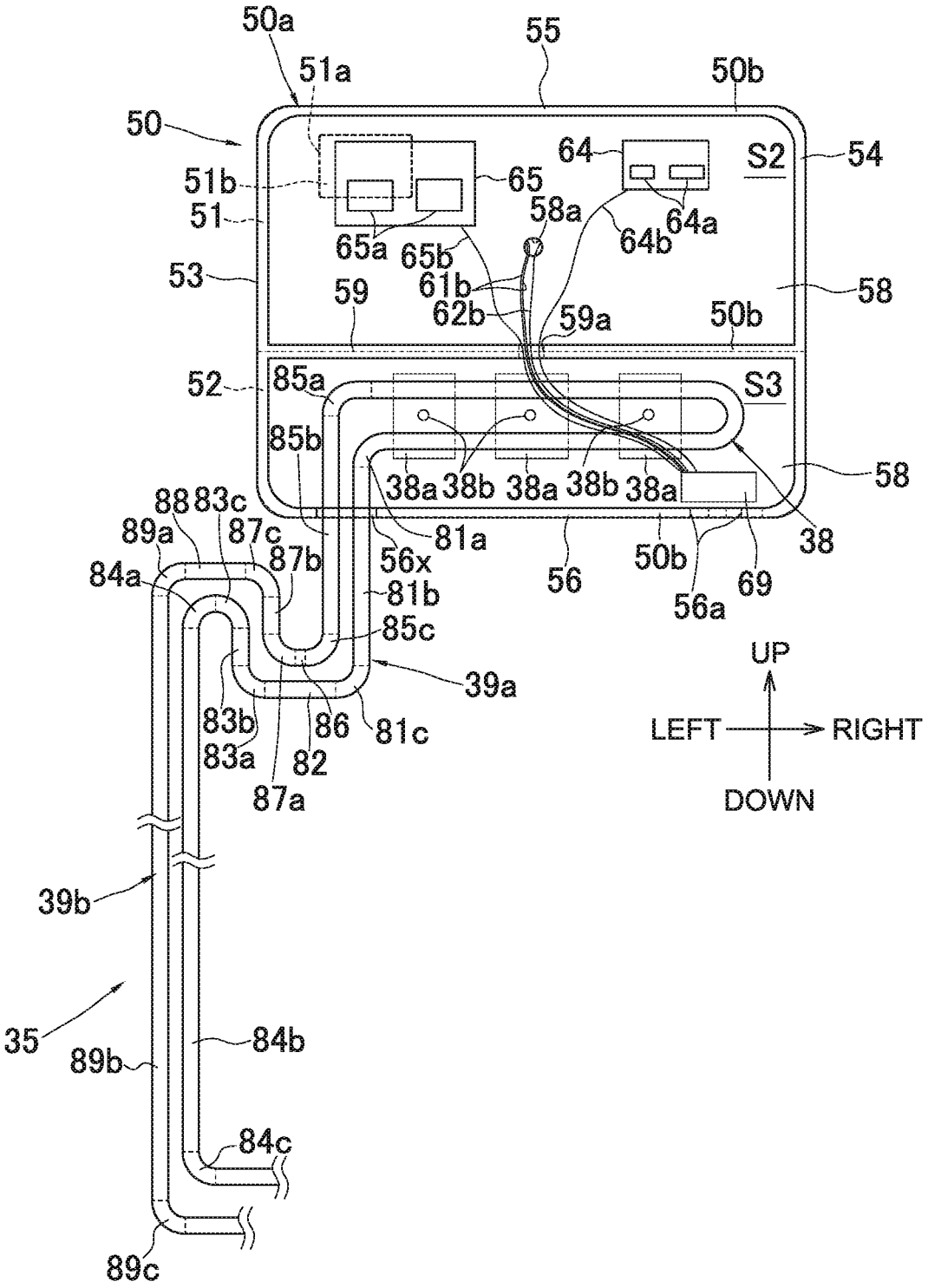
FIG. 6 is a schematic configuration diagram of the front side portion of the interior of the outdoor control unit as viewed from the front.
Figure 7:
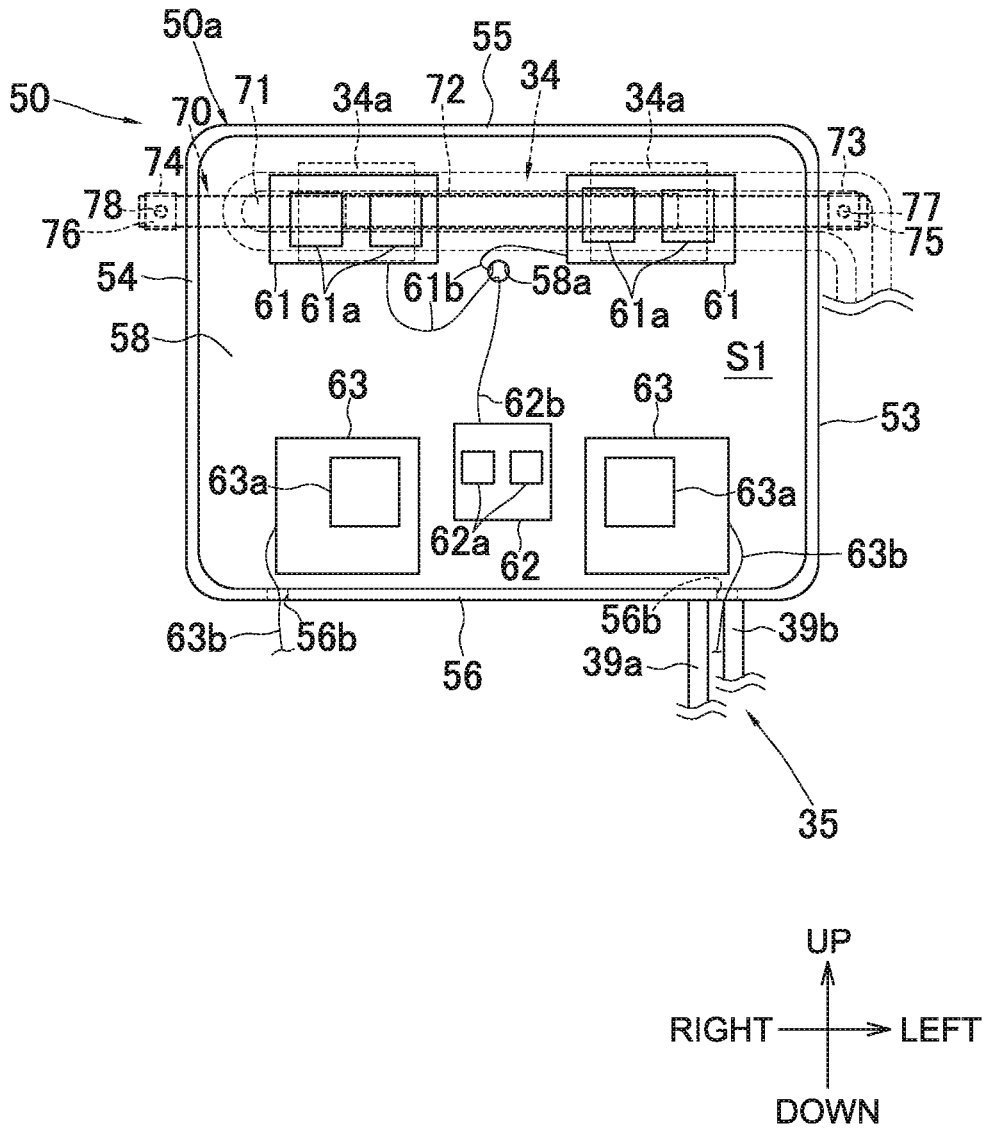
FIG. 7 is a schematic configuration diagram of the back side portion of the interior of the outdoor control unit as viewed from the back.
Figure 8:
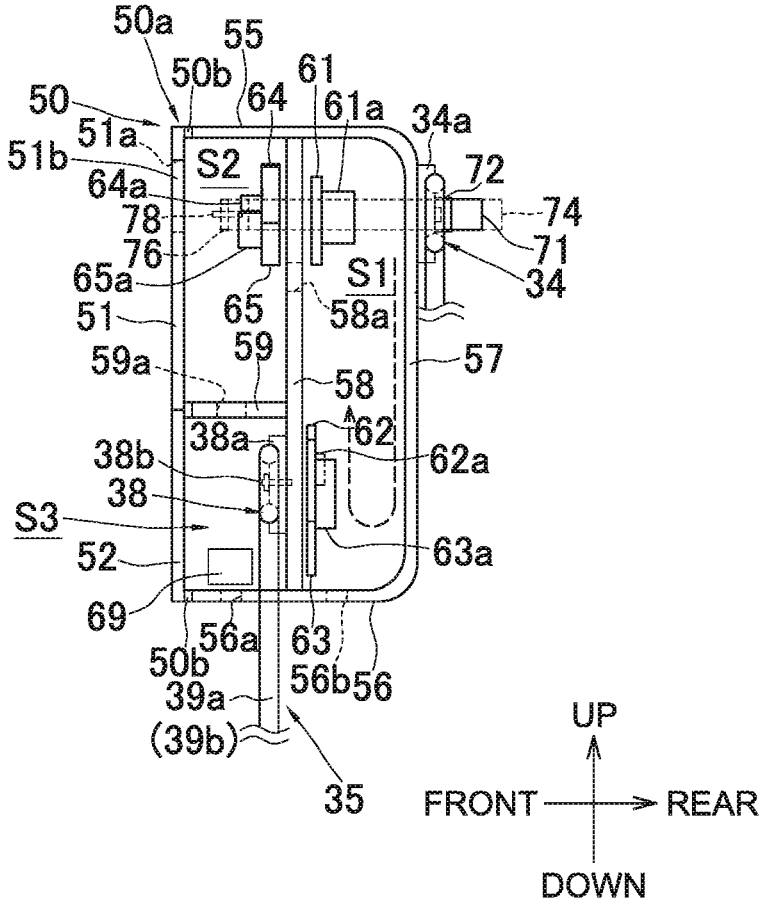
FIG. 8 is a schematic configuration diagram of the interior of the outdoor control unit as viewed from the right side.

FIG. 5 is a schematic configuration diagram of the interior of the outdoor control unit 50 in plan view. FIG. 6 is a schematic configuration diagram of the front side portion of the interior of the outdoor control unit 50 as viewed from the front. FIG. 7 is a schematic configuration diagram of the back side portion of the interior of the outdoor control unit 50 as viewed from the back. FIG. 8 is a schematic configuration diagram of the interior of the outdoor control unit 50 as viewed from the right side.

The outdoor control unit 50 has an electric component casing 50*a*, a first board 61, a second board 62, a third board 63, a fourth board 64, and a fifth board 65.

The electric component casing 50*a* has a back surface 57, a top surface 55, a lower surface 56, a right side surface 54, a left side surface 53, an upper front lid 51, a lower front lid 52, a second partition plate 58, and a first partition plate 59. The appearance of the electric component casing 50*a* is a substantially box shape formed by the back surface 57, the top surface 55, the lower surface 56, the right side surface 54, the left side surface 53, the upper front lid 51, and the lower front lid 52. Among them, the back surface 57, the top surface 55, the lower surface 56, the right side surface 54, the left side surface 53, the second partition plate 58, the first partition plate 59, the upper front lid 51, and the lower front lid 52 are made of metal except for the portion of a lid seal material 50*b* described later. Note that the back surface 57, the top surface 55, the lower surface 56, the right side surface 54, and the left side surface 53 are integrally formed. Note that when a plurality of metal plate members are used to form a single piece, the metal plate members may be coupled to each other so that no gaps are created by seaming. The upper front lid 51 and the lower front lid 52 are both sheet metal having a substantially rectangular shape in a front view, and constitute the front surface of the electric component casing 50*a*. The upper front lid 51 is located above the lower front lid 52. In one or more embodiments, the upper front lid 51 is larger than the lower front lid 52 in a front view.

Note that the upper front lid 51 has an inspection port 51*a* penetrating therethrough in the plate thickness direction. The inspection port 51*a* is openably closed by an inspection lid 51*b*.

The second partition plate 58 extends vertically and horizontally so as to partition the interior of the electric component casing 50*a* into the front side and the rear side. The second partition plate 58 is provided near the center of the interior of the electric component casing 50*a* in the front-rear direction. The first partition plate 59 extends horizontally so as to partition the space forward of the second partition plate 58 inside the electric component casing into the upper and lower sections. The first partition plate 59 is provided near the center in the interior of the electric component casing 50*a* in the vertical direction. As a result, the interior of the electric component casing 50*a* is partitioned into a first space S1 behind the second partition plate 58, a second space S2 forward of the second partition plate 58 and above the first partition plate 59, and a third space S3 forward of the second partition plate 58 and below the first partition plate 59.

Figure 9:
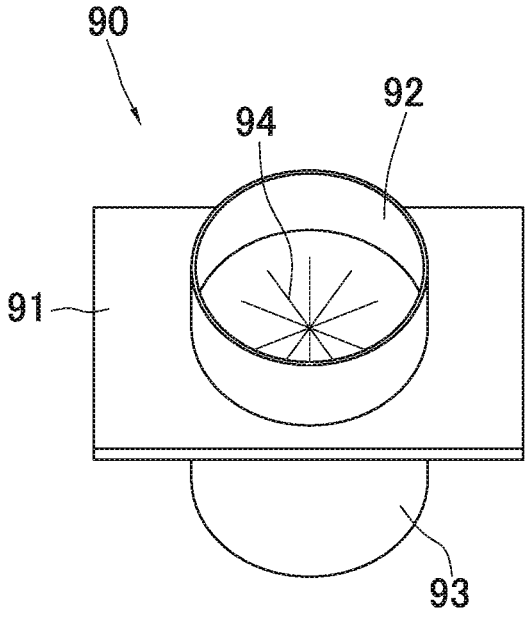
FIG. 9 is a schematic external perspective view of a wire seal material.

Note that the first partition plate 59 has a first opening 59*a* penetrating therethrough in the vertical direction so as to allow communication between the second space S2 and the third space S3. In addition, the second partition plate 58 has a second opening 58*a* penetrating therethrough in the front-rear direction so as to allow communication between the first space S1 and the second space S2. Note that the second partition plate 58 is not provided with an opening that allows direct communication between the first space S1 and the third space S3. A wire seal material 90 illustrated in FIG. 9 is attached to the first opening 59*a* of the first partition plate 59.

The lower surface 56 has, behind the second partition plate 58, an opening 56*b* that allows communication between the first space S1 and the external space below the electric component casing 50*a*. An electric wire 63*b* extending from an IPM provided on the third board 63 to be described later passes through the opening 56*b*. The wire seal material 90 illustrated in FIG. 9 is attached to the opening 56*b* of the lower surface 56. Note that the opening area of the opening 56*b* provided in lower surface 56 is substantially equal to the opening area of the second opening 58*a* provided in second partition plate 58, and is smaller than the opening area of the first opening 59*a* provided in the first partition plate 59.

Note that any elastic member can be used as the wire seal material 90, but in one or more embodiments, a rubber bush is used.

The wire seal material 90 has a partition portion 91, a first cylindrical portion 92, a second cylindrical portion 93, and a communication portion 94, and is formed from a flexible material such as rubber. The partition portion 91 has a substantially rectangular plate shape. The first cylindrical portion 92 is provided so as to extend out from the flat portion of the partition portion 91. The second cylindrical portion 93 is provided so as to extend out from the flat portion of the partition portion 91 to the opposite side to the first cylindrical portion 92 side. The communication portion 94 is provided at the position connecting the inside of the first cylindrical portion 92 and the inside of the second cylindrical portion 93 in the partition portion 91, and has a plurality of cuts radially provided so as to penetrate the partition portion 91 in the thickness direction. The wire seal material 90 is attached to the first partition plate 59 by fitting either the first cylindrical portion 92 or the second cylindrical portion 93 inside the first opening 59*a*. When viewed from the thickness direction of the first partition plate 59, the communication portion 94 of the wire seal material 90 is located inside the first opening 59*a* of the first partition plate 59.

Note that similarly, the wire seal material 90 illustrated in FIG. 9 is attached to the second opening 58*a* of the second partition plate 58. The wire seal material 90 is attached to the second partition plate 58 by fitting either the first cylindrical portion 92 or the second cylindrical portion 93 inside the second opening 58*a*. When viewed from the thickness direction of the second partition plate 58, the communication portion 94 of the wire seal material 90 is located inside the second opening 58*a* of the second partition plate 58.

The upper front lid 51 is fitted to the front edges of the top surface 55, the right side surface 54, the left side surface 53, and the first partition plate 59. Note that the top surface the lower surface 56, the right side surface 54, the left side surface 53, and the first partition plate 59 are provided with the lid seal material 50*b* to border the respective front edges. The lid seal material 50*b* may be, for example, a packing formed from rubber or the like provided along each of the front edges. The packing may be a U-shaped packing that sandwiches the edge. Since the lid seal material 50*b* is provided in this manner, when the upper front lid 51 is attached, the gap between the upper front lid 51 and the respective front edges of the top surface 55, the right side surface 54, the left side surface 53, and the first partition plate 59 is filled, and the hermeticity of the second space S2 can be enhanced.

The lower front lid 52 is fitted to the front edges of the lower surface 56, the right side surface 54, the left side surface 53, and the first partition plate 59. Similarly, with regard to the lower front lid 52, since the above-described lid seal material 50*b* is provided, when the lower front lid 52 is attached, the gap between the lower front lid 52 and the respective front edges of the lower surface 56, the right side surface 54, the left side surface 53, and the first partition plate 59 is filled, and the hermeticity of the third space S3 can be enhanced.

Note that the lower surface 56 has a movable surface 56*x* forward of the second partition plate 58 and in the vicinity of the left end. The movable surface 56*x* is formed with an opening for allowing the first connection pipe 39*a* and second connection pipe 39*b* to be described later, which are connected to the ends of the second cooling portion 38 of the second cooling circuit 35, to pass through in the vertical direction. The movable surface 56*x* can be separated from the lower surface 56 by sliding forward together with the first connection pipe 39*a* and the second connection pipe 39*b*.

Note that, of the surfaces constituting the outer periphery of the electric component casing 50*a*, the back surface 57 is the widest surface. The length of the back surface 57 in the left-right direction is longer than the length of the left side surface 53 in the front-rear direction, and is longer than the length of the right side surface 54 in the front-rear direction. Therefore, the first cooling portion 34 of the first cooling circuit 31 can ensure a sufficiently long region in the left-right direction for thermal contact with the back surface 57 of the electric component casing 50*a*.

The first board 61, the second board 62, the third board 63, the fourth board 64, and the fifth board 65 are all plate-shaped members extending vertically and horizontally, have a substantially rectangular shape in a front view, and are fixed to the second partition plate 58. Specifically, the two first boards 61 are provided in one or more embodiments, and are located separately on the left and right above the first space S1. In one or more embodiments, the two third boards 63 are provided, and are located separately on the left and right below the first space S1. The second board 62 is located between the two third boards 63 below the center in the left-right direction in the first space S1. The fourth board 64 is located on the upper right side in the second space S2. The fifth board 65 is located on the upper left side in the second space S2.

Each of the first boards 61 is provided with a noise filter 61*a*, which is an electric component and a heat-generating component. The second board 62 is provided with an intelligent power module (IPM) 62*a*, which is an electric component used for the outdoor fan 26 and is a heat-generating component. Each of the third boards 63 is provided with an intelligent power module (IPM) 63*a*, which is an electric component for the inverter of the compressor 21 and is a heat-generating component. Note that the noise filter 61*a*, the IPM 62*a*, and the IPM 63*a* are all housed in the first space S1, but are located forwardly away from the back surface 57 of the electric component casing 50*a*. As a result, even if the back surface 57 of the first space S1 is cooled by the first cooling portion 34 and condensation occurs on the back surface 57, the condensation water is suppressed from reaching the noise filter 61*a*, the IPM 62*a*, and the IPM 63*a*. Note that the first board 61, the second board 62, and the third board 63 are all used as they were when the outdoor unit 2 was shipped from the factory, without any work such as setting by a local worker when constructing the outdoor unit 2.

The fourth board 64 is an auxiliary control board and is provided with various electric components 64*a*. The fifth board 65 is a main control board and is provided with various electric components 65*a*. The refrigeration apparatus 1 according to one or more embodiments has optional functions that can be optionally selected or added according to a user's desire or the like. Optional functions include, but are not limited to, on-demand control. The optional functions can be set on the fourth board 64 and the fifth board 65 arranged in the second space S2 of the outdoor control unit 50. The settings for the optional functions in the outdoor control unit 50 are made by a local worker accessing the fourth board 64 and the fifth board 65 and performing manual operations thereon during the construction of the outdoor unit 2. Specifically, the fourth board 64 and the fifth board 65 are each provided with switches or the like for making settings. Access to the fifth board 65 having the electric components 65*a* and the fourth board 64 having the electric components 64*a* can be made by removing the upper front lid 51. Note that the upper front lid 51 covering the second space S2 from the front is provided with the inspection port 51*a* that is closed by the inspection lid 51*b*, as described above. Therefore, with respect to the fifth board 65, it is possible to perform work such as construction or maintenance through the inspection port 51*a* by simply removing the inspection lid 51*b* without removing the entire upper front lid 51. Note that if the initial settings at the time of construction are made, the second space S2 is sealed by the upper front lid 51 or the inspection lid 51*b*.

Note that an electric wire 61*b* extends from the first board 61. An electric wire 62*b* extends from the second board 62. An electric wire 63*b* extends from the third board 63. An electric wire 64*b* extends from the fourth board 64. An electric wire 65*b* extends from the fifth board 65. Note that these electric wires 61*b*, 62*b*, 63*b*, 64*b*, and 65*b* are illustrated only in FIGS. 6 and 7. The electric wires 61*b*, 62*b*, 64*b*, and 65*b* are connected to the connection terminals of a terminal block 69 that is provided on the lower right side in the third space S3. The electric wire 63*b* passes through the opening 56*b* by passing through the communication portion 94 of the wire seal material 90 attached to the lower surface 56 below the first space S1, and is then connected to the compressor 21.

Here, the electric wire 64*b* extending from the fourth board 64 and the electric wire extending from the fifth board 65 in the second space S2 are drawn into the third space S3 through the first opening 59*a*, which is provided in the vicinity of the center of the first partition plate 59 so as to penetrate the first partition plate 59 in the vertical direction, and connected to the connection terminals of the terminal block 69. More specifically, the electric wire 64*b* and the electric wire 65*b* pass through the first opening 59*a* by passing through the communication portion 94 of the wire seal material 90 attached to the first partition plate 59.

In addition, the electric wire 61*b* extending from the first board 61 and the electric wire 62*b* extending from the second board 62 in the first space S1 are drawn into the second space S2 through the second opening 58*a*, which is provided in the vicinity of the center of the second partition plate 58 so as to penetrate the second partition plate 58 in the front-rear direction, then drawn into the third space S3 through the first opening 59*a* in the first partition plate 59, and connected to the connection terminals of the terminal block 69. More specifically, the electric wire 61*b* and the electric wire 62*b* pass through the second opening 58*a* by passing through the communication portion 94 of the wire seal material 90 attached to the second partition plate 58, and then pass through the first opening 59*a* by passing through the communication portion 94 of the wire seal material 90 attached to the first partition plate 59.

Note that the electric wire extending from equipment to be connected other than the compressor 21 is connected to the connection terminal of the terminal block 69. An opening 56*a* for allowing passage of the electric wire extending from equipment other than the compressor 21 is provided in the portion of the lower surface 56 of the electric component casing 50*a* which is located below the terminal block 69 in the third space S3. In one or more embodiments, the electric wire 63*b* that passes through the opening 56*b* of the lower surface 56 located below the first space S1 is already connected to the compressor 21 at the time of the factory shipment of the outdoor unit 2, but the electric wire extending from other equipment and the connection terminal of the terminal block 69 are not connected at the time of the factory shipment of the outdoor unit 2, and are connected by a local worker during construction. Specifically, the worker removes the lower front lid 52 to release the third space S3, connects the electric wire extending from equipment other than the compressor 21 to the connection terminal of the terminal block 69 through the opening 56*a* in the lower surface 56, and seals the third space S3 with the lower front lid 52. Note that the wire seal material 90 described above is attached to the opening 56*a* to suppress the intrusion of relatively large dust into the third space S3. In addition, in the third space S3, with the lower front lid 52 attached, the lid seal material 50*b* fills the gap between the lower front lid 52 and the front edges of the lower surface 56, the right side surface 54, the left side surface 53, and the first partition plate 59, so that the hermeticity is ensured. The third space S3 is slightly connected to the space outside the electric component casing 50*a* through the opening 56*a* even with the wire seal material 90 attached thereto. In addition, the terminal block 69 is provided in the third space S3 as described above, and the lower front lid 52 is removed and exposed to the outside for wiring connection work during construction. For this reason, the degree of sealing of the third space S3 among the spaces in the electric component casing 50*a* is the lowest. The third space S3 may satisfy the protection grade IP55 or IP55 or more specified in JIS C 0920.

In addition, in the second space S2, with the upper front lid 51 attached, the lid seal material 50*b* brings the upper front lid 51 into close contact with the front edges of the top surface 55, the right side surface 54, the left side surface 53, and the first partition plate 59, so that the hermeticity is ensured. The second space S2 is connected to the space outside the electric component casing 50*a* only through a slight gap that can exist between the inspection port 51*a* and the inspection lid 51*b* in the upper front lid 51, or through the first opening 59*a* with the wire seal material 90 attached thereto in the first partition plate 59, the third space S3, and the opening 56*a* with the wire seal material 90 attached thereto. In addition, setting work is performed on the fourth board 64 and the electric components 65*a*, which are arranged in the second space S2, as necessary to meet a user's request. Thus, the exposure of the second space S2 to the outside is limited to exposure by removal of the inspection lid 51*b* or exposure by removal of the upper front lid 51 in such necessary cases. Thus, the degree of sealing of the second space S2 is higher than the degree of sealing of the third space S3. Specifically, the degree of sealing of the second space S2 may satisfy the protection grade IP55 or IP55 or more specified in JIS C 0920, or satisfy IP66.

Further, the first space S1 is covered with the back surface 57, the top surface 55, the lower surface 56, the right side surface 54, and the left side surface 53 which are integrally formed, and the second partition plate 58 that is screwed and fixed thereto, so that the hermeticity is ensured. Moreover, the first space S1 is connected to the space outside the electric component casing 50*a* only through the opening 56*b* with the wire seal material 90 attached thereto in the lower surface 56, or through the second opening 58*a* with the wire seal material 90 attached thereto in the second partition plate 58, the second space S2, the first opening 59*a* with the wire seal material 90 attached thereto in the first partition plate 59, the third space S3, and the opening 56*a* with the wire seal material 90 attached thereto. Among them, the electric wire 63*b* passing through the opening 56*b* in the lower surface 56 is already connected to the compressor 21 at the time of the factory shipment of the outdoor unit 2. As described above, since no on-site work is scheduled for the electric wire 63*b*, the region between the edge of the opening 56*b* in the lower surface 56 and the electric wire 63*b* is sufficiently sealed by factory work using the wire seal material 90. Furthermore, during the field construction of the outdoor unit 2, no dust can enter the first space S1 through the opening 56*b* in the lower surface 56. Therefore, dust from the external space of the electric component casing 50*a* is sufficiently suppressed from entering the first space S1 through the opening 56*b*. Thus, the degree of sealing of the first space S1 is higher than the degree of sealing of the second space S2. Specifically, the degree of sealing of the first space S1 may satisfy the protection grade IP55 or IP55 or more specified in JIS C 0920, or may satisfy IP66.

(5) Cooling by First Cooling Portion 34

The first space S1 of the outdoor control unit 50 is cooled by the first cooling portion 34 of the first cooling circuit 31. Specifically, the first cooling portion 34 of the first cooling circuit 31 is provided in the vicinity of the upper end on the back side of the electric component casing 50*a* so as to be in thermal contact with the back side of the electric component casing 50*a* with the plurality of first heat transfer members 34*a* interposed therebetween. The first heat transfer members 34*a* have a flat surface that extends parallel to the back surface 57 of the electric component casing 50*a*, and are used in such a manner that the flat surface is in surface contact with the back surface 57. The first cooling portion 34 extends from the left end to the right end at the back of the electric component casing 50*a*, then turns back through the U-shaped portion, and extends to the left end, so that the outgoing and returning sections are vertically aligned.

As described above, in the first space S1 of the outdoor control unit 50, the upper space on the back side is cooled by the first cooling portion 34 of the first cooling circuit 31, thereby allowing natural convection such as indicated by the dotted line in FIG. 8 to occur in the first space S1, and allowing an increase in the cooling efficiency of the first space S1. Specifically, the cold air generated on the upper back side of the first space S1 descends on the back side, and then is warmed by cooling the IPM 62*a* and the IPM 63*a*, which are heat-generating components, rises as an updraft on the front side, also cools the noise filter 61*a*, which is a heat-generating component, and circulates. In one or more embodiments, since the IPM 62*a* and the IPM 63*a* have a higher degree of heat generation than the noise filter 61*a*, the IPM 62*a* and the IPM 63*a* can be preferentially cooled.

The plurality of first heat transfer members 34*a* are fixed in a state of being pressed toward the back surface 57 of the electric component casing 50*a* by using a fixing portion 70 and a spacer 72 to be described below.

The fixing portion 70 has a back-side fixation member 71, a left-side fixation member 73, a right-side fixation member 74, a left-side fixation-receiving member 75, a right-side fixation-receiving member 76, a screw 77, and a screw 78.

The back-side fixation member 71 is a bar-shaped member that extends along the left-right direction which is the longitudinal direction of the first cooling portion 34 in the vicinity of the upper end of the back surface 57 of the electric component casing 50*a*. The right end of the back-side fixation member 71 is located further rightward than the right side surface 54 of the electric component casing 50*a*. The left end of the back-side fixation member 71 is located further leftward than the left side surface 53 of the electric component casing 50*a*.

The left-side fixation member 73 is a bar-shaped member that extends along the front-rear direction in the vicinity of the upper end of the left side surface 53 of the electric component casing 50*a*. The rear end of the left-side fixation member 73 is coupled to the left end of the back-side fixation member 71. The left-side fixation-receiving member 75 is fixed to the outside of the left side surface 53 of the electric component casing 50*a* by brazing, screws, or the like. The left-side fixation-receiving member 75 has a fixation-receiving portion forward of the center of the electric component casing 50*a* in the front-rear direction, the fixation-receiving portion protruding further leftward from the left side surface 53. The screw 77 fastens the front end of the left-side fixation member 73 and the fixation-receiving portion of the left-side fixation-receiving member 75. Specifically, with the fixation-receiving portion of the left-side fixation-receiving member 75 disposed in contact with the front end of the left-side fixation member 73 from the front, the screw 77 is screwed from the front of the fixation-receiving portion of the left-side fixation-receiving member 75 toward the rear to fasten the both. The left-side fixation member 73 is pulled forward by being coupled to the left-side fixation-receiving member 75 with the screw 77. As a result, the left end of the back-side fixation member 71 coupled to the left-side fixation member 73 is urged toward the front.

The right-side fixation member 74 is a bar-shaped member that extends along the front-rear direction in the vicinity of the upper end of the right side surface 54 of the electric component casing 50*a*. The rear end of the right-side fixation member 74 is coupled to the right end of the back-side fixation member 71. The right-side fixation-receiving member 76 is fixed to the outside of the right side surface 54 of the electric component casing 50*a* by brazing, screws, or the like. The right-side fixation-receiving member 76 has a fixation-receiving portion forward of the center of the electric component casing 50*a* in the front-rear direction, the fixation-receiving portion protruding further rightward from the right side surface 54. The screw 78 fastens the front end of the right-side fixation member 74 and the fixation-receiving portion of the right-side fixation-receiving member 76. Specifically, with the fixation-receiving portion of the right-side fixation-receiving member 76 disposed in contact with the front end of the right-side fixation member 74 from the front, the screw 78 is screwed from the front of the fixation-receiving portion of the right-side fixation-receiving member 76 toward the rear to fasten the both. The right-side fixation member 74 is pulled forward by being coupled to the right-side fixation-receiving member 76 with the screw 78. As a result, the right end of the back-side fixation member 71 coupled to the right-side fixation member 74 is urged toward the front.

Note that the spacer 72 is provided so as to be in contact with the back side of the plurality of first heat transfer members 34*a*, and is a bar-shaped member that extends along the left-right direction which is the longitudinal direction of the first cooling portion 34. The back-side fixation member 71 is in contact with the back side of the spacer 72. The left end of the spacer 72 is located further rightward than the left end of the back-side fixation member 71, and the right end of the spacer 72 is located further leftward than the right end of the back-side fixation member 71. The portion of the first cooling portion 34 extending leftward from the lower end of the U-shaped portion is located below the spacer 72, and the portion of the first cooling portion 34 extending leftward from the upper end of the U-shaped portion is located above the spacer 72. The U-shaped portion of the first cooling portion 34 is located further rightward than the right end of the spacer 72. This prevents the back-side fixation member 71 from crushing the U-shaped portion of the first cooling portion 34, even when the back-side fixation member 71 is urged toward the front.

Note that the first cooling portion 34 of the first cooling circuit 31 is located between the back surface 57 of the electric component casing 50*a* and the back-side fixation member 71 as viewed from the top. As a result, the back surface 57, the first cooling portion 34, and the back-side fixation member 71 are arranged in this order from the front.

With the above arrangement configuration, the left-side fixation member 73 and the right-side fixation member 74 are urged toward the front, so that the back-side fixation member 71 can press the plurality of first heat transfer members 34*a* against the back surface 57 of the electric component casing 50*a* via the spacer 72. The plurality of first heat transfer members 34*a* to which the first cooling portion 34 of the first cooling circuit 31 is fixed maintain good contact with the back surface 57 of the electric component casing 50*a*. As a result, the first cooling portion 34 of the first cooling circuit 31 can be brought into thermal contact with the back surface 57 of the electric component casing 50*a*.

(6) Cooling by Second Cooling Portion 38

In the upper vicinity of the portion of the second partition plate 58 of the outdoor control unit 50 which faces the third space S3, the second cooling portion 38 of the second cooling circuit 35 is provided in thermal contact with the second board 62 and the third board 63 with the plurality of second heat transfer members 38*a* interposed therebetween. The second heat transfer members 38*a* have a flat surface that extends in parallel to the second partition plate 58, and are used in such a manner that the flat surface is in surface contact with the second partition plate 58.

The first connection pipe 39*a* and the second connection pipe 39*b* connected to the ends of the second cooling portion 38 pass vertically through the opening of the movable surface 56*x* that is provided at the portion of the lower surface 56 of the electric component casing 50*a* which is located at the lower left of the third space S3. As a result, the second cooling circuit 35 is drawn into the third space S3, and the second cooling portion 38 is located in the third space S3. In the third space S3, the second cooling portion 38 extends from the region where the second cooling portion 38 is connected to the end of the first connection pipe 39*a* to the right end, then turns back through the U-shaped portion, and extends back to the left side until reaching the region where the second cooling portion 38 is connected to the end of the second connection pipe 39*b*. The connecting region between the second connection pipe 39*b* and the second cooling portion 38 is lined up above the connecting region between the first connection pipe 39*a* and the second cooling portion 38.

As described above, the upper vicinity of the portion of the second partition plate 58 of the outdoor control unit 50 which faces the third space S3 is cooled by the second cooling portion 38 of the second cooling circuit 35, whereby the IPM 62*a* and the IPM 63*a*, which are heat-generating components provided in the first space S1 facing the surface of the second partition plate 58 on the opposite side to the third space S3, can be cooled.

Note that each of the second heat transfer members 38*a* is fixed to the second partition plate 58 from the front side by a screw 38*b* that extends in the front-rear direction.

(7) Movement of Second Cooling Portion 38

The second cooling circuit 35 has the first connection pipe 39*a* that extends from one end of the second cooling portion 38 on the lower side and the second connection pipe 39*b* that extends from the other end of the second cooling portion 38 on the upper side.

The first connection pipe 39*a* has pipe portions of a first curved portion 81*a*, a first straight portion 81*b*, a second curved portion 81*c*, a second straight portion 82, a third curved portion 83*a*, a third straight portion 83*b*, a fourth curved portion 83*c*, a fifth curved portion 84*a*, a fourth straight portion 84*b*, and a sixth curved portion 84*c*. The first curved portion 81*a*, the first straight portion 81*b*, the second curved portion 81*c*, the second straight portion 82, the third curved portion 83*a*, the third straight portion 83*b*, the fourth curved portion 83*c*, the fifth curved portion 84*a*, the fourth straight portion 84*b*, and the sixth curved portion 84*c* are connected to each other in this order from one end of the second cooling portion 38 on the lower side. Note that the first straight portion 81*b*, the third straight portion 83*b*, and the fourth straight portion 84*b* all extend in the vertical direction. In one or more embodiments, the fourth straight portion 84*b* is longer than the first straight portion 81*b* and longer than the third straight portion 83*b*. The second straight portion 82 extends in the left-right direction. The first curved portion 81*a*, the second curved portion 81*c*, the third curved portion 83*a*, the fourth curved portion 83*c*, the fifth curved portion 84*a*, and the sixth curved portion 84*c* all have a 90-degree curved shape.

The second connection pipe 39*b* has pipe portions of a seventh curved portion 85*a*, a fifth straight portion 85*b*, an eighth curved portion 85*c*, a sixth straight portion 86, a ninth curved portion 87*a*, a seventh straight portion 87*b*, a tenth curved portion 87*c*, an eighth straight portion 88, an eleventh curved portion 89*a*, a ninth straight portion 89*b*, and a twelfth curved portion 89*c*. The seventh curved portion 85*a*, the fifth straight portion 85*b*, the eighth curved portion 85*c*, the sixth straight portion 86, the ninth curved portion 87*a*, the seventh straight portion 87*b*, the tenth curved portion 87*c*, the eighth straight portion 88, the eleventh curved portion 89*a*, the ninth straight portion 89*b*, and the twelfth curved portion 89*c* are connected to each other in this order from the other end of the second cooling portion 38 on the upper side. Note that the fifth straight portion 85*b*, the seventh straight portion 87*b*, and the ninth straight portion 89*b* all extend in the vertical direction. In one or more embodiments, the ninth straight portion 89*b* is longer than the fifth straight portion 85*b* and longer than the seventh straight portion 87*b*. The sixth straight portion 86 and the eighth straight portion 88 extend in the left-right direction. The seventh curved portion 85*a*, the eighth curved portion 85*c*, the ninth curved portion 87*a*, the tenth curved portion 87*c*, the eleventh curved portion 89*a*, and the twelfth curved portion 89*c* all have a 90-degree curved shape.

With the above configuration, the first connection pipe 39*a* bends downward at the first curved portion 81*a* from the lower end of the second cooling portion 38 and extends downward at the first straight portion 81*b*, thereby penetrating the movable surface 56*x* in the vertical direction and extending outward and downward from the electric component casing 50*a*. Then the first connection pipe 39*a* bends leftward at the second curved portion 81*c*, extends leftward at the second straight portion 82, and then bends upward at the third curved portion 83*a*. Further, the first connection pipe 39*a* extends upward at the third straight portion 83*b*, then bends leftward at the fourth curved portion 83*c*, bends downward at the fifth curved portion 84*a*, then extends downward at the fourth straight portion 84*b*, and bends rightward at the sixth curved portion 84*c*.

In addition, the second connection pipe 39*b* bends downward at the seventh curved portion 85*a* from the upper end of the second cooling portion 38 and extends downward at the fifth straight portion 85*b*, thereby penetrating the movable surface 56*x* in the vertical direction and extending outward and downward from the electric component casing 50*a*. Then the second connection pipe 39*b* bends leftward at the eighth curved portion 85*c*, extends leftward at the sixth straight portion 86, and then bends upward at the ninth curved portion 87*a*. Further, the second connection pipe 39*b* extends upward at the seventh straight portion 87*b* and then bends leftward at the tenth curved portion 87*c*. Furthermore, the second connection pipe 39*b* extends leftward at the eighth straight portion 88, then bends downward at the eleventh curved portion 89*a*, extends downward at the ninth straight portion 89*b*, and then bends rightward at the twelfth curved portion 89*c*.

Here, the first connection pipe 39*a* and the second connection pipe 39*b* extend along each other, and the portion extending substantially parallel to the direction that is the axis of rotation when rotating the second cooling circuit 35 is ensured to be sufficiently long.

Figure 10:
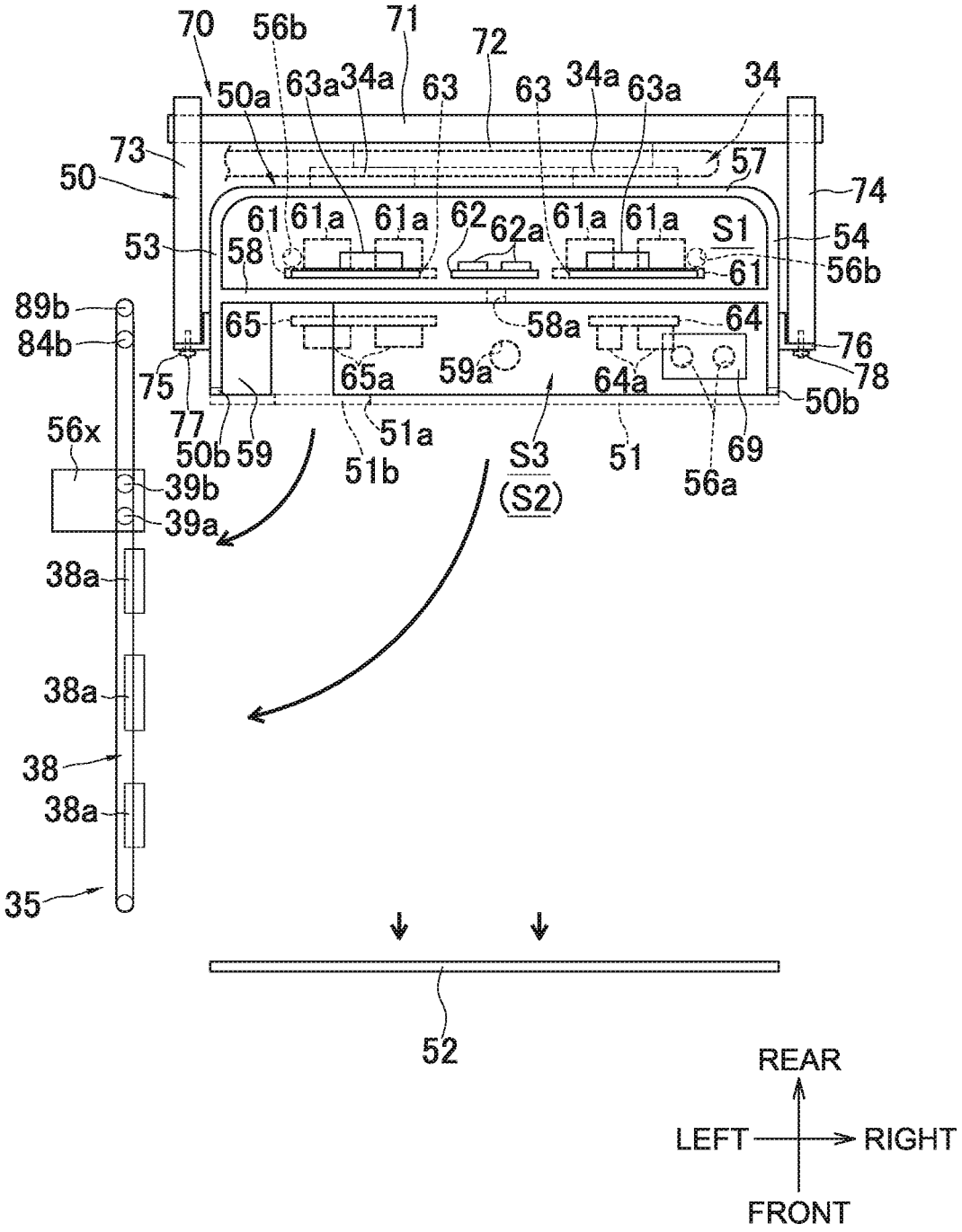
FIG. 10 is a schematic configuration diagram of the periphery of the outdoor control unit in plan view in a state where the second cooling portion is turned forward.

As illustrated in FIG. 10, the second cooling circuit 35 described above can be moved toward the front during the construction of the outdoor control unit 50 and during maintenance after the construction.

Here, when moving the second cooling circuit 35, first, the worker removes the upper front panel 16 of the outdoor unit casing 11 to expose the opening 16*a*. Then the worker accesses the outdoor control unit 50 through the opening 16*a* of the outdoor unit casing 11, and removes the lower front lid 52 of the outdoor control unit 50. Next, the operator removes the second heat transfer members 38*a* from the second partition plate 58 by removing the screws 38*b*. In this state, the operator rotates the second cooling circuit 35 by 90 degrees by twisting the fourth straight portion 84*b* of the first connection pipe 39*a* and the ninth straight portion 89*b* of the second connection pipe 39*b* as the axes of rotation, or by twisting the region between the fourth straight portion 84*b* and the ninth straight portion 89*b* as the axis of rotation. As a result, the second cooling portion 38 of the second cooling circuit 35 can be moved toward the front while keeping the movable surface 56*x* of the lower surface 56 of the electric component casing 50*a* integral with the first connection pipe 39*a* and the second connection pipe 39*b*. Here, the second cooling portion 38, the first connection pipe 39*a*, and the second connection pipe 39*b* in the second cooling circuit 35 can be arranged so as not to overlap with the rest of the outdoor control unit 50 in a front view.

Figure 11:
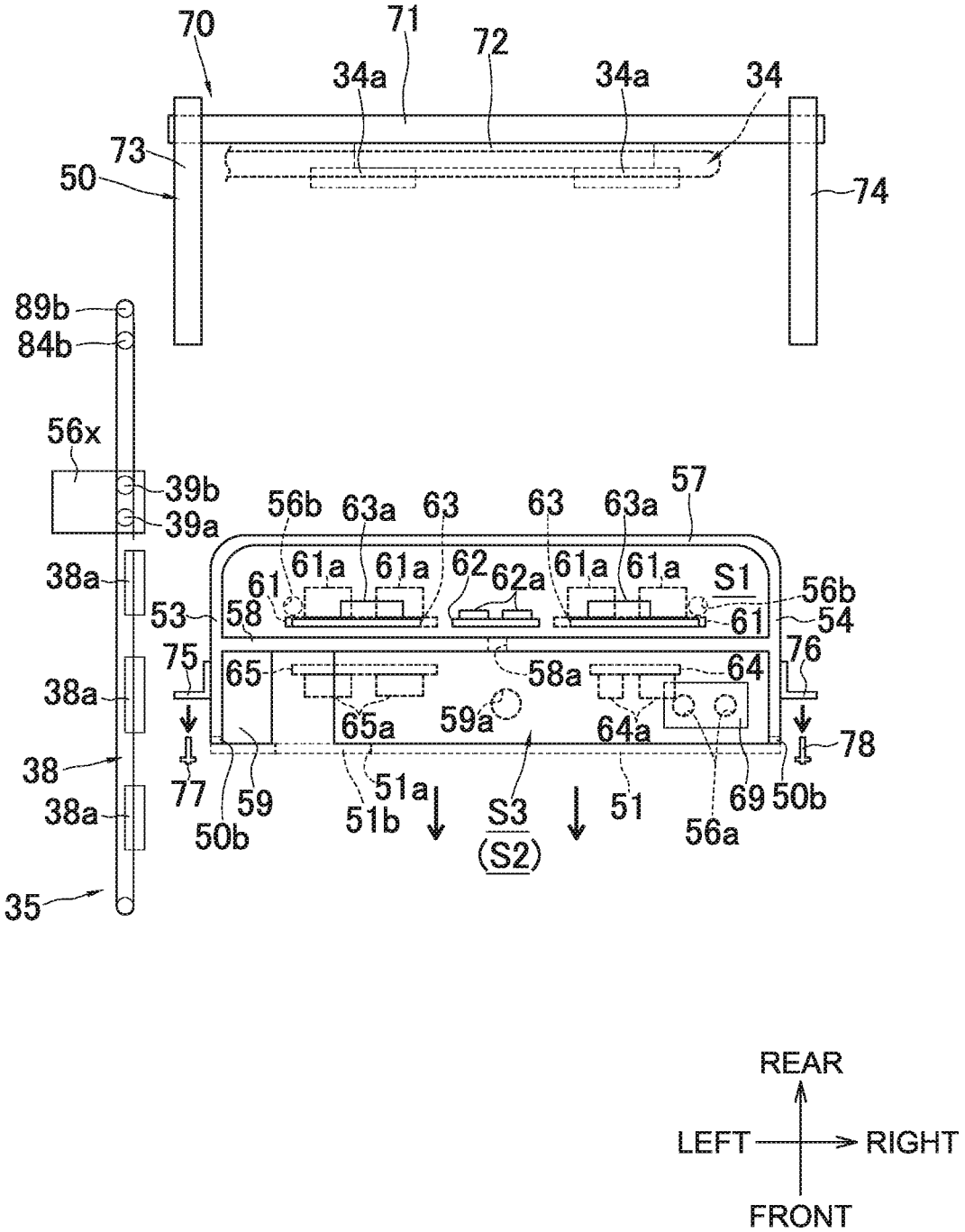
FIG. 11 is a schematic configuration diagram in plan view illustrating how the outdoor control unit is removed forward.

Subsequently, as illustrated in FIG. 11, the worker removes the screw 77 fixed to the left-side fixation member 73 and the screw 78 fixed to the right-side fixation member 74 in order to press and fix the first cooling portion 34 against the back surface 57 of the electric component casing 50*a*. As a result, the worker can remove the portion of the outdoor control unit 50 other than the lower front lid 52 of the electric component casing 50*a*, and an object to be removed that includes the first board 61, the second board 62, the third board 63, the fourth board 64, and the fifth board 65, as a single unit to the front side.

(8) Features of Embodiments

The outdoor unit 2 of the refrigeration apparatus 1 according to one or more embodiments can cool the heat-generating components of the outdoor control unit 50 using the first cooling portion 34 of the first cooling circuit 31 and the second cooling portion 38 of the second cooling circuit 35. Therefore, it is possible to prevent the temperature of the heat generating components of the outdoor control unit 50 from excessively increasing, and to enhance the reliability of the outdoor control unit 50.

In addition, the outdoor control unit 50 of one or more embodiments adopts a hermetically-sealed structure, and in particular, can suppress the intrusion of dust into the second space S2 and the first space S1. Note that in the outdoor control unit 50 adopting the hermetically-sealed structure, it is difficult to guide the air flow formed by the outdoor fan 26 into the electric component casing 50*a* to promote heat dissipation from the electric components inside. However, the outdoor control unit 50 according to one or more embodiments can sufficiently cool the electric components using the first cooling portion 34 and the second cooling portion 38. As a result, the outdoor control unit 50 can suppress dust intrusion while cooling the heat-generating components.

In addition, in the outdoor unit 2 according to one or more embodiments, the degree of sealing of the first space S1 of the outdoor control unit 50 is higher than the degree of sealing of the second space S2 or the third space S3. Moreover, during the construction of the outdoor unit 2, no initial settings are made for the first board 61 having the noise filter 61*a*, the second board 62 having the IPM 62*a*, and the third board 63 having the IPM 63*a*, which are arranged in the first space S1, and the first space S1 is not released during construction. Therefore, it is possible to suppress the intrusion of dust into the first space S1.

Here, for the fourth board 64 having the electric components 64*a* and the fifth board having the electric components 65*a*, which are arranged in the second space S2, optional initial settings are made according to a user's desire during the construction of the outdoor unit 2, by a local worker removing the inspection lid 51*b* for access thereto through the inspection port 51*a*, or removing the upper front lid 51 for access thereto. As described above, the outdoor control unit 50 includes a portion to be exposed to the outside of the electric component casing 50*a* during initial setting, but only the second space S2 can be exposed, and the first space S1 can be limited to exposure through the second opening 58*a*. For this reason, even if the outdoor control unit 50 has boards and electric components for which initial settings are made during construction, it is possible to suppress adverse effects of dust on the boards and electric components arranged in the first space S1. In addition, a low level of dust resistance is sufficient for the boards or electric components placed in the first space S1.

In addition, in the outdoor control unit 50, the opening 56*a* for allowing passage of the electric wire extending from equipment to be connected other than the compressor 21 and the terminal block 69 to which the electric wire extending from equipment other than the compressor 21 is connected are provided in the third space S3. Furthermore, during construction, the work of connecting the electric wire extending from equipment other than the compressor 21 to the connection terminal of the terminal block 69 through the opening 56*a* is performed. In this way, during construction, in order to operate the connection terminal of the terminal block 69, the lower front lid 52 is removed and the third space S3 is released. Therefore, dust from outside the electric component casing 50*a* may enter the third space S3. Moreover, the electric wires 64*b* and 65*b* connected to the connection terminals of the terminal block 69 are connected to the fourth board 64 and the fifth board 65 arranged in the second space S2. In addition, the electric wires 61*b* and 62*b* connected to the connection terminals of the terminal block 69 are connected to the first board 61 and second board 62 arranged in the first space S1. Therefore, the dust that has entered the third space S3 may reach the second space S2 or the first space S1. However, in the outdoor control unit 50 according to one or more embodiments, the third space S3 and the second space S2 are partitioned by the first partition plate 59, the wire seal material 90 is attached to the first opening 59*a* provided in the first partition plate 59, and the peripheries of the electric wires 61*b*, 62*b*, 64*b*, and 65*b* is covered with the wire seal material 90. Therefore, even if dust enters the third space S3, the dust is suppressed from reaching the second space S2. Further, in the outdoor control unit 50, the second space S2 and the first space S1 are partitioned by the second partition plate 58, the wire seal material 90 is attached to the second opening 58*a* provided in the second partition plate 58, and the peripheries of the electric wires 61*b* and 62*b* are covered with the wire seal material 90. In addition, the second partition plate 58 is not provided with an opening that allows direct communication between the third space S3 and the first space S1. Furthermore, since the opening 56*b* in the lower surface 56 provided below the first space S1 is not a region to be operated during on-site construction, the opening 56*b* is already sufficiently sealed by the wire seal material 90 when the outdoor unit 2 is shipped from the factory, and remains unreleased even during on-site construction. Therefore, even if dust reaches the second space S2, the dust is suppressed from reaching the first space S1.

In addition, the first cooling portion 34 of the first cooling circuit 31 is in thermal contact with the relatively wide back surface 57 of the electric component casing 50*a* of the outdoor control unit 50 to perform cooling. Therefore, it is possible to sufficiently provide the cooling effect of the electric components by the first cooling portion 34. In addition, since the first cooling portion 34 provides sufficient cooling effect as described above, it is not necessary to dispose the first cooling circuit 31 along the left side surface 53 and right side surface 54 of the electric component casing 50*a*, and it is not necessary to make the left side surface 53 and the right side surface 54 long in the front-rear direction in order to secure a wide cooling surface. For this reason, the dimension of the electric component casing 50*a* in the front-rear direction can be reduced. Thus, the electric component casing 50*a* is less likely to obstruct the air flow in the space surrounded by the outdoor heat exchanger 23, and the air volume by the outdoor fan 26 is easily secured.

Furthermore, the outdoor unit 2 according to one or more embodiments allows the outdoor control unit 50 to be easily maintained by removing the upper front panel 16 of the outdoor unit casing 11 to expose the opening 16*a*.

In addition, in the outdoor unit 2 according to one or more embodiments, the first cooling portion 34 of the first cooling circuit 31 is fixed in such a manner as to be pressed against the back surface 57 of the electric component casing 50*a* from behind. As a result, the cooling effect of the back surface 57 of the electric component casing 50*a* by the first cooling portion 34 can be enhanced. In addition, with the upper front panel 16 of the outdoor unit casing 11 removed to expose the opening 16*a*, the first cooling portion 34 of the first cooling circuit 31 is located behind the electric component casing 50*a*, and therefore it is difficult to directly press the first cooling portion 34 against the electric component casing 50*a*. Meanwhile, in one or more embodiments, the back-side fixation member 71 is used to press the first cooling portion 34 against the back surface 57 of the electric component casing 50*a*. The left-side fixation member 73 and the right-side fixation member 74 are coupled to the left and right ends of the back-side fixation member 71. Furthermore, the left-side fixation member 73 and the right-side fixation member 74 are pulled forward and fixed to the left-side fixation-receiving member 75 and the right-side fixation-receiving member 76, respectively. The fixing work using the screw 77 and the screw 78 on the left-side fixation-receiving member and the right-side fixation-receiving member 76 can be performed from the front side through the opening 16*a* of the outdoor unit casing 11. Thus, the structure for enhancing the cooling effect of the back surface 57 of the electric component casing 50*a* can be achieved by work from the front side through the opening 16*a* of the outdoor unit casing 11.

Here, in the outdoor unit 2 according to one or more embodiments, the second cooling portion 38 is located in the front of the outdoor control unit 50. However, in a state where the upper front panel 16 of the outdoor unit casing 11 removed to expose the opening 16*a*, the second cooling portion 38 can be rotationally moved toward the front. This makes it easy to access the outdoor control unit 50 through the opening 16*a* of the outdoor unit casing 11, and also makes it easy to remove the outdoor control unit 50.

(9) Other Embodiments

(9-1) Other Embodiments A

In the above embodiments, the case where for the fifth board 65 and the fourth board 64 arranged in the second space S2, initial settings are made as necessary at the time of the construction of the outdoor unit 2, according to a user's desire or the like, has been described as an example.

Meanwhile, for example, the outdoor control unit 50 may be such that during construction, no operation is performed on the fourth board 64 and the fifth board 65 arranged in the second space S2. Note that since no operation during construction is performed on the fourth board 64 and the fifth board 65 arranged in the second space S2, the upper front lid 51 is not removed during construction, and the inspection lid 51*b* is not removed. Therefore, the second space S2 is not exposed to the outside.

(9-2) Other Embodiments B

In the above embodiments, the outdoor control unit 50 having both the first space S1 and the second space S2 inside the electric component casing 50*a* has been described as an example.

Meanwhile, as the outdoor control unit 50, the casing forming the first space S1 and the casing forming the second space S2 may be separately disposed apart. Even in this case, the initial settings at the time of the construction of the outdoor unit 2 can be completed by performing the initial settings for the boards and electric components arranged in the second space S2, and no operation is required for the first space S1. Therefore, it is possible to protect the boards and electric components arranged in the first space S1 from the intrusion of dust.

(9-3) Other Embodiments C

In the above embodiments, the case where the outdoor control unit 50 is cooled by the second cooling portion 38 of the second cooling circuit 35 from the front side and cooled by the first cooling portion 34 of the first cooling circuit 31 from the rear side has been described as an example.

Meanwhile, for example, if the electric components of the outdoor control unit 50 can be sufficiently cooled, the cooling by the second cooling portion 38 may be omitted, and the configuration may be such that the second cooling circuit 35 according to the above embodiments is not provided.

(9-4) Other Embodiments D

In the above embodiments, the case where the back-side fixation member 71 presses the plurality of first heat transfer members 34*a* against the back surface 57 of the electric component casing 50*a* via the spacer 72 has been described as an example.

Meanwhile, the back-side fixation member 71 according to the above embodiments may include a shape portion corresponding to the spacer 72 according to the above embodiments, thereby eliminating the need for the spacer 72 as a separate member.

Specifically, the back-side fixation member 71 may include a portion bulging forward at a position on the left side of the U-shaped portion of the first cooling portion 34, between the portion of the first cooling portion 34 extending leftward from the lower end of the U-shaped portion and the portion of the first cooling portion 34 extending leftward from the upper end of the U-shaped portion. As a result, even without the spacer 72 as a separate member, the plurality of first heat transfer members 34*a* can be pressed against the back surface 57 of the electric component casing 50*a* without crushing the first cooling portion 34.

(9-5) Other Embodiments E

In the above embodiments, the case where the back-side fixation member 71 is used in a state of being coupled to the left-side fixation member 73 and the right-side fixation member 74 has been described as an example.

However, the back-side fixation member 71, the left-side fixation member 73, and the right-side fixation member 74 may be integrally molded instead of separate members.

In addition, instead of the configuration in which the front end of the left-side fixation member 73 is fixed to the left-side fixation-receiving member 75 by the screw 77, the left-side fixation member 73 may be configured so as to have a claw that extends forward until reaching the left edge of the upper front lid 51, protrudes to the right at the front end, and can be hooked on the left edge of the upper front lid 51. Similarly, instead of the configuration in which the front end of the right-side fixation member 74 is fixed to the right-side fixation-receiving member 76 by the screw 78, the right-side fixation member 74 may be configured so as to have a claw that extends forward until reaching the right edge of the upper front lid 51, protrudes to the left at the front end, and can be hooked on the right edge of the upper front lid 51.

As described above, the fixing portion 70 is not limited as long as the back-side fixation member 71 can be pressed against the plurality of first heat transfer members 34*a*.

(9-6) Others

The degree of hermetic sealing can be determined on the basis of the possibility of access by a worker, and the size of the opening in the region where the worker performs sealing work on site. In the relative determination of the degree of hermetic sealing, the degree of possibility of access by the worker is preferentially determined, and if the possibility is the same, the determination may be made by the size of the opening in the region where the worker performs the sealing work on site. Note that, the possibility of access by the worker can be evaluated as high, for example, for regions that are scheduled to be accessed and worked on in advance, and the possibility can be evaluated as medium for regions where work is optionally performed according to user's choice. Note that examples of the scheduled work include setting work and wiring connection work, and may not include equipment failure or error processing.

Note that the seal material may have a portion located between the first wire and the edge of the first opening when viewed from the direction in which the first wire passes through the first opening.

Note that the first lid may be provided with an openable and closable inspection port.

Note that the first portion and the second portion may be one integrally molded component or may be separate components.

Supplement

Although the disclosure has been described with respect to only a limited number of embodiments, those skilled in the art, having benefit of this disclosure, will appreciate that various other embodiments may be devised without departing from the scope of the present disclosure. Accordingly, the scope of the disclosure should be limited only by the attached claims.

REFERENCE SIGNS LIST

1 refrigeration apparatus
2 Outdoor Unit
4 Indoor Unit
5 gas-refrigerant communication pipe
6 liquid-refrigerant communication pipe
10 refrigerant circuit
11 outdoor unit casing (casing)
16 upper front panel
16*a* opening (maintenance opening)
21 compressor
23 outdoor heat exchanger
26 outdoor fan
30 cooling circuit
31 first cooling circuit (refrigerant pipe)
34 first cooling portion (cooling portion)
34*a* first heat transfer member (heat transfer material)
35 second cooling circuit
38 second cooling portion
50 outdoor control unit (electric component unit)
50*a* electric component casing (housing, hermetic container)
50*b* lid seal material
51 upper front lid (first surface)
51*a* inspection port
51*b* inspection lid
52 lower front lid (first surface)
53 left side surface (side surface)
54 right side surface
57 back surface (cooling surface, second surface)
58 second partition plate
58*a* second opening
59 first partition plate
59*a* first opening
61*a* noise filter (first electric component)
61*b* electric wire (second wire)
62*a* IPM (first electric component)
62*b* electric wire (second wire)
63*a* IPM (first electric component)
63*b* electric wire (second wire)
64*a* electric component (second electric component)
64*b* electric wire (first wire)
65*a* electric component (second electric component)
65*b* electric wire (first wire)
69 terminal block
70 fixing portion (holder)
71 back-side fixation member (first portion)
72 spacer
73 left-side fixation member (second portion)
74 right-side fixation member (second portion)
90 wire seal material (seal material)
S1 first space (first chamber)
S2 second space (second chamber)
S3 third space (third chamber)

PATENT LITERATURE

Patent Literature 1: Japanese Laid-Open Patent Publication No. 2010-2121

What is claimed is:

1. An electric component unit in an outdoor unit of a refrigeration apparatus, the electric component unit comprising:

a first electric component;

a first chamber that houses the first electric component;

a second electric component;

a second chamber that houses the second electric component; and a partition plate separating the first chamber and the second chamber, wherein the first chamber has a higher degree of hermetic sealing than the second chamber, and the partition plate has an opening that connects the first chamber and the second chamber.

2. An electric component unit in an outdoor unit of a refrigeration apparatus, the electric component unit comprising:

a first electric component;

a first chamber that houses the first electric component;

a second electric component;

a second chamber that houses the second electric component;

a first wire;

a terminal block connected to the second electric component through the first wire; and a third chamber that houses the terminal block, wherein the first chamber has a higher degree of hermetic sealing than the second chamber, and the second chamber has a higher degree of hermetic sealing than the third chamber.

3. The electric component unit according to claim 2, further comprising:

a first partition plate that partitions the second chamber and the third chamber, wherein the first partition plate:

has a first opening through which the first wire passes, and comprises a seal material between the first wire and an edge of the first opening.

4. The electric component unit according to claim 3, further comprising:

a second wire that connects the first electric component to the terminal block; and a second partition plate that:

partitions the first chamber and the second chamber, and has a second opening, wherein the second wire passes through the second opening and the first opening.

5. The electric component unit according to claim 2, further comprising:

a first partition plate that partitions the second chamber and the third chamber, wherein the second chamber has a first lid that is openable and closable, and the third chamber has a second lid that is separate from the first lid and openable and closable.

6. An electric component unit in an outdoor unit of a refrigeration apparatus, the electric component unit comprising:

a first electric component;

a first chamber that houses the first electric component;

a second electric component;

a second chamber that houses the second electric component; and a housing having:

the first chamber and the second chamber inside, and an inspection port that is openable and closable at a position connecting an outside of the housing and the second chamber, wherein the first chamber has a higher degree of hermetic sealing than the second chamber.

7. An outdoor unit of a refrigeration apparatus, comprising:

an electric component unit in the outdoor unit, the electric component unit comprising:

a first electric component;

a first chamber that houses the first electric component;

a second electric component; and a second chamber that houses the second electric component;

a refrigerant pipe that:

comprises a cooling portion that is in thermal contact with the electric component unit, and circulates a refrigerant; and a casing:

having a maintenance opening and housing the electric component unit and the refrigerant pipe, wherein the first chamber has a higher degree of hermetic sealing than the second chamber, and the electric component unit is disposed between the cooling portion of the refrigerant pipe and the maintenance opening of the casing.

8. The outdoor unit according to claim 7, wherein the electric component unit comprises a hermetic container that houses the first electric component, and the cooling portion of the refrigerant pipe is in thermal contact with the hermetic container.

9. The outdoor unit according to claim 7, wherein the hermetic container has:

a first surface on a side of the maintenance opening, a second surface on an opposite side of the first surface to the side of the maintenance opening, and a side surface connecting the first surface and the second surface, and the second surface is wider than the side surface.

10. The outdoor unit according to claim 9, wherein the hermetic container has a degree of hermetic sealing that satisfies a protection grade IP55 specified in JIS C 0920.

11. The outdoor unit according to claim 9, wherein the cooling portion of the refrigerant pipe is in thermal contact with the hermetic container at a position biased upward in the hermetic container.

12. The outdoor unit according to claim 9, wherein the cooling portion of the refrigerant pipe is in thermal contact with a cooling surface of the hermetic container opposite from a side of the maintenance opening, and the first electric component is inside the hermetic container and separated from the cooling surface.

13. The outdoor unit according to claim 7, further comprising a heat transfer material between the electric component unit and the cooling portion of the refrigerant pipe.

14. The outdoor unit according to claim 13, further comprising a holder pressing the heat transfer material against the electric component unit and fixing the heat transfer material.

15. The outdoor unit according to claim 14, further comprising;

a spacer between the holder and the heat transfer material, wherein the cooling portion of the refrigerant pipe is between the electric component unit and the holder, and the holder presses the heat transfer material against the electric component unit via the spacer.

16. The outdoor unit according to claim 14, wherein the holder comprises:

a first portion on an opposite side of the heat transfer material to a side of the electric component unit, and a second portion connected to the first portion and extending along a lateral side of the electric component unit toward a side of the maintenance opening, and the holder:

pulls the second portion toward the side of the maintenance opening, and presses the heat transfer material against the electric component unit with the first portion.

* * * * *